US009901968B2

(12) United States Patent
Nozu

(10) Patent No.: US 9,901,968 B2
(45) Date of Patent: Feb. 27, 2018

(54) PIPE BEND DIE UNIT, AND PIPE BENDING APPARATUS HAVING THE UNIT

(71) Applicant: SANGO CO., LTD., Miyoshi-shi, Aichi-ken (JP)

(72) Inventor: Kentaro Nozu, Nagakute (JP)

(73) Assignee: SANGO CO., LTD., Miyoshi-shi, Aichi-ken (JP)

( * ) Notice: Subject to any disclaimer, the term of this patent is extended or adjusted under 35 U.S.C. 154(b) by 0 days.

(21) Appl. No.: 14/892,311

(22) PCT Filed: Jun. 9, 2015

(86) PCT No.: PCT/JP2015/066571
§ 371 (c)(1),
(2) Date: Nov. 19, 2015

(87) PCT Pub. No.: WO2015/190465
PCT Pub. Date: Dec. 17, 2015

(65) Prior Publication Data

US 2016/0175909 A1 Jun. 23, 2016

(30) Foreign Application Priority Data

Jun. 10, 2014 (JP) ..... 2014-119613
Dec. 26, 2014 (JP) ..... 2014-263966

(51) Int. Cl.
*B21D 7/04* (2006.01)
*B21D 7/024* (2006.01)
(Continued)

(52) U.S. Cl.
CPC ..... *B21D 7/04* (2013.01); *B21D 7/024* (2013.01); *B21D 7/025* (2013.01); *B21D 9/03* (2013.01);
(Continued)

(58) Field of Classification Search
CPC ... B21D 7/00; B21D 7/02; B21D 7/04; B21D 7/024; B21D 7/022; B21D 7/025;
(Continued)

(56) References Cited

U.S. PATENT DOCUMENTS 3,901,064 A * 8/1975 Jacobson ..... B21D 7/022 72/219
5,337,590 A 8/1994 Schuchert et al.
(Continued)

FOREIGN PATENT DOCUMENTS

JP 52-71368 6/1977
JP 11-512029 A 10/1999
(Continued)

OTHER PUBLICATIONS

International Search Report (PCT/ISA/210) dated ??, by the Japanese Patent Office as the International Searching Authority for International Application No. PCT/JP2015/066571.
(Continued)

*Primary Examiner* — Teresa M Ekiert
*Assistant Examiner* — Gregory Swiatocha
(74) *Attorney, Agent, or Firm* — Buchanan Ingersoll & Rooney PC

(57) ABSTRACT

A pipe bend die unit comprises a clamp member having a first groove part of half-circular cross section on an outer peripheral surface thereof with a fitting recess extending in a peripheral direction by a first predetermined length on a planar surface perpendicular to a rotary axis, and a counter pressure member having a second groove part of half-circular cross section formed on an outer peripheral surface thereof, and a fitting protrusion extending in a peripheral direction by a second predetermined length from a tip end portion of the second groove part. The fitting protrusion is positioned in the fitting recess so that the first and second
(Continued)

groove parts are combined to form a pipe-receiving groove of half-circular cross section. The counter pressure member and the clamp member are hingedly connected to one another so as to be rotatable relative to each other about the rotary axis.

19 Claims, 23 Drawing Sheets

(51) Int. Cl.

| | |
|---|---|
| ***B21D 7/025*** | (2006.01) |
| ***B21D 9/03*** | (2006.01) |
| ***B21D 9/05*** | (2006.01) |
| ***B21D 9/07*** | (2006.01) |
| ***B21D 37/14*** | (2006.01) |

(52) U.S. Cl.
CPC ..... *B21D 9/055* (2013.01); *B21D 9/073* (2013.01); *B21D 37/145* (2013.01)

(58) Field of Classification Search
CPC . B21D 7/028; B21D 7/08; B21D 9/07; B21D 9/03; B21D 9/055; B21D 9/073; B21D 9/05; B21D 37/145
See application file for complete search history.

(56) References Cited

U.S. PATENT DOCUMENTS

| | | | | |
|---|---|---|---|---|
| 6,009,737 | A | 1/2000 | Bandy | |
| 6,220,069 | B1 * | 4/2001 | Wehmeyer | B21D 7/024 72/149 |
| 7,032,422 | B2 * | 4/2006 | Hatano | B21D 9/07 72/150 |
| 2003/0205074 | A1 * | 11/2003 | O'Donnell | B21D 7/024 72/155 |
| 2008/0110223 | A1 * | 5/2008 | Zuber | B21D 7/024 72/309 |
| 2010/0170317 | A1 * | 7/2010 | Saito | B21D 7/02 72/298 |

FOREIGN PATENT DOCUMENTS

| | | | |
|---|---|---|---|
| JP | 2004-9125 | A | 1/2004 |
| JP | 2008-246504 | A | 10/2008 |
| JP | 2010-167470 | A | 8/2010 |
| JP | 2012-55952 | A | 3/2012 |

OTHER PUBLICATIONS

Written Opinion (PCT/ISA/237) dated ??, by the Japanese Patent Office as the International Searching Authority for International Application No. PCT/JP2015/066571.
Notice of Allowance dated Nov. 12, 2015 by the Japanese Patent Office in counterpart Japanese Application No. 2015-543175, with English language translation of Notice of Allowance.
Notice of Application Number dated Aug. 31, 2015 by the Japanese Patent Office based on International Application No. PCT/JP2015/066571, with English language translation.

* cited by examiner

PIPE BEND DIE UNIT, AND PIPE BENDING APPARATUS HAVING THE UNIT

TECHNICAL FIELD

The present invention relates to a pipe bend die unit that is appropriate for bending a pipe, and a pipe bending apparatus having the unit.

BACKGROUND ART

As for working to bend a pipe, various kinds of working such as press bending, compression bending, extract bending, draw bending and the like are known heretofore, among which a rotary draw bending is most popular. According to an ordinary rotary draw bending, a pipe is held by a clamp die against a bend die with a groove formed on its outer peripheral surface, and the bend die and clamp die are rotated, with the pipe being pressed toward the bend die by means of a pressure die, then the pipe is moved in a tangential direction, thereby to be bent along the groove of the bend die, as disclosed in the second columns of Patent document 1, for example, and also disclosed in Patent document 2, in its paragraphs (0003)-(0006) and FIG. 11, wherein the bend die is described as a roll die.

In Patent document 2, with respect to a wiper or shoe provided for preventing a crinkling from being created on the inner side of a bent portion of the pipe, a specific wiper is proposed to do with wear or breakage caused by a sliding motion, as described in its paragraphs (0013) and (0014). Likewise, in Patent document 3, it is described in its paragraph (0005) as an object to provide a pipe bending apparatus having a wear resistance, being used for various kinds of pipes without causing a problem, and having a very long life without requiring adjusting operations very often, and such a pipe bending apparatus is proposed in its paragraph (0006) that is characterized in that the pipe bending apparatus has a bend die with its outer peripheral surface formed in a circular arc of a predetermined curvature to bend a pipe, a clamp member clamping the pipe with the bend die, and a wiper rotating the clamp member about the bend die to prevent a crinkling from being created when the pipe is bent, and that a tip end portion of the wiper in the rotating direction of the clamp member is extended along the curvature of the outer peripheral surface of the bend die beyond an initial point for bending the pipe.

Furthermore, in Patent document 4, with respect to a method and apparatus for quickly and accurately changing die sets for different-sized tubing to be bent or for different types of tube bending operations, it is described in its page 7 that a preassembled die set has been devised for tube bending apparatus wherein the die set is comprised of a bend die, clamp die and pressure die adapted to be mounted on a spindle of a tube bending table, the improvement comprising first means releasably interconnecting the pressure die and clamp die to the bend die in predetermined, aligned relation to one another and to the bend die, and handling means for engaging the die set in order to simultaneously lift and remove said dies comprising each die set from the table. And, it is described in its page 8 that many tube bending operations require the use of a wiper die and mandrel, which may also provide a part of each preassembled die set when needed, and such an embodiment that the wiper die is joined to the bend die by a wiper die arm is disclosed in its page 15 and FIG. 6.

PRIOR ART DOCUMENT

Patent Document

Patent document 1: U.S. Pat. No. 5,337,590
Patent document 2:
Japanese Patent Laid-open Publication No. 2004-9125
Patent document 3:
Japanese Patent Laid-open Publication No. 2008-246504
Patent document 4:
Japanese Patent Laid-open Publication No. Hei-11-512029

SUMMARY OF THE INVENTION

Problems to be Solved by the Invention

Although it is configured to form the crinkling intentionally in Patent document 1, in order to prevent the crinkling being created when the draw rotary bending is performed, a crinkling prevention is employed in general, so that the wiper is disposed in Patent documents 2, 3 and 4. Among them, each wiper as described in Patent documents 2 and 4 has a tip end portion formed into a wedge shape, and possible wear of the tip edge portion was concerned in Patent document 2, so that a counter measure has been considered. Particularly, there is a step along the initial line for bending the pipe, normally a line where a surface including a rotary axis of the bend die intersects an inner surface of a groove of the bend die, a crinkling resulted from the step cannot be avoided. In order to minimize this crinkling, it is necessary to maintain the wedge shape of the tip end portion of the wiper, especially necessary to make the tip end portion as thinner as possible, so that the wiper is fragile and lacks its durability. Furthermore, a periodic wear countermeasure is unavoidable, and frequent replacements are required. In addition, as an initial setting for the bending is difficult, skilled technique is required. Therefore, it is difficult to perform a large amount of bending operations continuously.

In contrast, according to Patent document 3, a wiper disclosed as one embodiment therein configures a part of a central die section out of bending die sections which were divided into three sections along a vertical direction, and it is formed with a recess portion of a circular arc cross section, as described in its Paragraphs (0025)-(0030). Consequently, it is described in its Paragraph (0032) that a tip end portion with an edge structure is not required, and that there will be no possibility for creating a step between the bend die and the wiper, the reason of which has not been explained. Supposing that, from a start to an end of bending operation applied to a pipe to be formed, out of the bending die sections divided into three sections along three planar surfaces parallel to a pipe axis, upper and lower side die sections perform the bending, and the central section performs as the wiper, thereby to perform separate operations, not only it is difficult to prevent the crinkling from being created, but also it is difficult to perform the bending operation appropriately. No disclosure can be found about a configuration for enabling a desired bending operation.

In the meantime, although it is described in Patent document 4 that the die set with the bend die, clamp die and pressure die being preassembled can be changed to perform bending operations in different forms, as described in its Page 11, a wiper die is not necessarily required. In other words, Patent document 4 focuses on a performance of changing dies, but never discloses such a die set that can change dies with the performance of appropriately preventing the crinkling from being created, nor discloses a pipe bend die unit that is appropriate for bending a pipe and a pipe bending apparatus having the pipe bend die unit.

Accordingly, it is an object of the present invention to provide a pipe bend die unit that can perform bending a pipe appropriately without creating a crinkling. And, it is another object of the present invention to provide a pipe bending apparatus having the pipe bend die unit which is appropriate for the bending.

It is a further object of the present invention to provide a pipe bend die unit that can perform bending a pipe appropriately without creating a crinkling, and perform changing dies easily, and to provide a pipe bending apparatus having the unit.

Means for Solving the Problems

To solve the above-described problems, the present invention comprises a bend die with a pipe-receiving groove of half-circular cross section formed on an outer peripheral surface of the bend die, the bend die being rotatable about a rotary axis, and the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another so as to be rotatable relative to each other about the rotary axis.

In the pipe bend die unit as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated. Or, it may be so configured that a fitting portion of the fitting protrusion that is positioned in the fitting recess is located at a foreside in an advancing direction of the pipe relative to a position where a bending operation of the pipe is initiated, and that a mating portion at which the first groove part of the clamp member and the second groove part of the counter pressure member mate is located at a backside in the advancing direction of the pipe relative to the position where the bending operation of the pipe is initiated.

It may be so configured that the counter pressure member has an annular rotary support portion mounted to be rotatable about the rotary axis, and that a part of the rotary support portion forms the fitting protrusion, and that the rotary support portion possesses an outer peripheral surface, the outer peripheral surface of the rotary support portion being a curved surface forming a part of the pipe-receiving groove of half-circular cross section. Furthermore, it may be so configured that the counter pressure member and the clamp member are hingedly connected by an axial member having a central axis passing through the fitting recess.

Also, in the pipe bend die unit as described above, it may be so configured that the clamp member has a circularly recessed portion forming the first groove part of half-circular cross section, the fitting recess extending in a peripheral direction on a planar surface perpendicular to the rotary axis, the fitting recess being located at a bottom center of the circularly recessed portion, the first groove part of half-circular cross section being continuous with the circularly recessed portion including a part of the fitting recess, and that the counter pressure member includes a curved surface portion formed on opposite sides of the planar surface, the curved surface portion being configured to contact the circularly recessed portion, the curved surface portion possessing an arch center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis, next to the curved surface portion.

Furthermore, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated.

Or, it may be so configured that the counter pressure member has an annular rotary support portion mounted to be rotatable about the rotary axis, and a body portion formed integrally with the rotary support portion, the second groove part of half-circular cross section and the curved surface portion being provided on the body portion of the counter pressure member, a part of the rotary support portion being formed integrally with the body portion and extending outwardly in a radial direction of the rotary support portion, and that the rotary support portion forms the fitting protrusion, and the rotary support portion possesses an outer peripheral surface, the outer peripheral surface of the rotary support portion being a curved surface forming a part of the pipe-receiving groove of half-circular cross section. Particularly, it may be so configured that the second groove part of half-circular cross section of the body portion of the counter pressure member forms an obtuse angle with a side surface of an end portion of the second groove part formed next to the curved surface portion. It may be so configured that the counter pressure member comprises at least a first member and a second member, the rotary support portion constituting a main part of the first member, and the body portion constituting a main part of the second member, the counter pressure member being formed by combining the first member and the second member.

Also, in the pipe bend die unit as described above, the bend die may be configured by an upper section and a lower section divided by a surface perpendicular to the rotary axis, the fitting protrusion of the counter pressure member being disposed between the upper section and the lower section.

Also, in the pipe bend die unit as described above, it may be so configured that the counter pressure member is divided into at least two members, the at least two members being a mating member including the fitting protrusion and a rotary support member supported to be rotatable about the rotary axis, the mating member being detachably connected to the rotary support member. It may be so configured that the clamp member and the counter pressure member comprise a plurality of members divided by a plurality planes perpendicular to the rotary axis, and that the plurality of members are stacked to form the clamp member and the counter pressure member. Furthermore, it may further comprise a knock pin fixed to a predetermined position of the clamp member, to provide an initial relative position between the clamp member and the counter pressure member by a position where the counter pressure member abuts on the knock pin.

Also, the present invention is to provide a pipe bending apparatus that comprises a bend die having a pipe-receiving groove of half-circular cross section on an outer peripheral surface of the bend die, the bend die being rotatable about a rotary axis, a clamp die for clamping a pipe to be bent that is positioned in the pipe-receiving groove of the bend die, and a pressure die for pressing the pipe toward the bend die, and that the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another so as to be rotatable relative to each other about the rotary axis, to configure a pipe bend die unit.

Also, in the pipe bending apparatus as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated.

Furthermore, it may be so configured that the clamp member has a circularly recessed portion forming the first groove part of half-circular cross section, the fitting recess extending in a peripheral direction on a planar surface perpendicular to the rotary axis, the fitting recess being located at a bottom center of the circularly recessed portion, the first groove part of half-circular cross section being continuous with the circularly recessed portion including a part of the fitting recess, and that the counter pressure member includes a curved surface portion formed on opposite sides of the planar surface, the curved surface portion being configured to contact the circularly recessed portion, the curved surface portion possessing an arch center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis, next to the curved surface portion.

Furthermore, it may be so configured that the counter pressure member has an annular rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, and that the rotary support portion forms the fitting protrusion, and the rotary support portion possesses an outer peripheral surface, the outer peripheral surface of the rotary support portion being a curved surface forming a part of the pipe-receiving groove of half-circular cross section. Also, the counter pressure member may comprise at least a first member and a second member, the rotary support portion constituting a main part of the first member, and the body portion constituting a main part of the second member, the counter pressure member being formed by combining the first member and the second member.

In the pipe bending apparatus as described above, it may be so configured that the counter pressure member and the clamp member are hingedly connected by an axial member having a central axis passing through the fitting recess. Also, the bend die may be configured by an upper section and a lower section divided by a surface perpendicular to the rotary axis, the fitting protrusion of the counter pressure member being disposed between the upper section and the lower section.

Also, in the pipe bending apparatus as described above, it may further comprise a knock pin fixed to a predetermined position of the clamp member, to provide an initial relative position between the clamp member and the counter pressure member by a position where the counter pressure member abuts on the knock pin. Furthermore, the apparatus may comprise a mandrel with a tip end portion thereof being inserted into the pipe, the mandrel being driven such that the tip end portion opposes the pressure die within a predetermined rotating region of the bend die.

Effects of the Invention

As the present invention is configured as described above, the following effects can be achieved. That is, according to the pipe bend die unit of the present invention, the bend die configuring it comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, and the counter pressure member and the clamp member are hingedly connected to one another so as to be rotatable relative to each other about the rotary axis. Therefore, the bending of the pipe can be achieved appropriately without causing the crinkling. Furthermore, if a plurality of pipe bend die units are prepared in accordance with various shapes of pipes to be bent, when a pipe is to be bent in a shape, a pipe bend die unit for the shape to be bent may be simply selected and changed, so that such a pipe bend die unit can be provided that its die change can be performed easily, and that no adjustment is required after the die change.

In the pipe bend die unit as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, or if such a configuration is employed that a fitting portion of the fitting protrusion positioned in the fitting recess is located at a foreside in an advancing direction of the pipe relative to a position where a bending operation of the pipe is initiated, and a mating portion at which the first groove part of the clamp member and the second groove part of the counter pressure member is located at a backside of the advancing direction of the pipe relative to the position where the bending operation of the pipe is initiated, smooth bending of the pipe can be achieved without causing the crinkling.

If the counter pressure member is formed to have an annular rotary support portion mounted to be rotatable about the rotary axis, it can be surely supported to be rotatable about the rotary axis. Particularly, it can be hingedly connected with the clamp member easily, and if it is so configured that a part of the rotary support portion forming the fitting protrusion, and that the rotary support portion possesses an outer peripheral surface, with the outer peripheral surface of the rotary support portion being a curved surface forming a part of the pipe-receiving groove of half-circular cross section, the counter pressure member can be formed as a single part with an appropriate shape. Also, if it is so configured that the counter pressure member and the clamp member are hingedly connected by an axial member having a central axis passing through the fitting recess, smooth bending of the pipe can be achieved without causing the crinkling.

In the pipe bend die unit as described above, if such a configuration is employed that the clamp member has a circularly recessed portion forming the first groove part of half-circular cross section, the fitting recess extending in a peripheral direction on a planar surface perpendicular to the rotary axis, the fitting recess being located at a bottom center of the circularly recessed portion, the first groove part of half-circular cross section being continuous with the circularly recessed portion including a part of the fitting recess, and that the counter pressure member includes a curved surface portion formed on opposite sides of the planar surface, the curved surface portion being configured to contact the circularly recessed portion, the curved surface portion possessing an arch center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis, next to the curved surface portion, then, the tip end portion of the curved surface portion of the counter pressure member at the initial position for bending the pipe tightly contacts the circularly recessed portion of the clamp member, whereas a clearance is formed between the curved surface portion of the counter pressure member and the circularly recessed portion at other portions than the tip end portion, even if the relative rotational angle between the clamp member and the counter pressure member is changed. Therefore, the counter pressure member can be assembled with the clamp member easily and appropriately, without causing an interference with the circularly recessed portion, and a durability of the counter pressure member will be improved.

In the pipe bend die unit as described above, if it is so configured that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, smooth bending of the pipe can be achieved without causing the crinkling.

If the counter pressure member is formed to have an annular rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, the counter pressure member can be surely supported to be rotatable about the rotary axis, and can be hingedly connected with the clamp member easily.

In addition, as a part of the rotary support portion is formed to extend outwardly in a radial direction of the rotary support portion, stress concentration applied to the rotary support portion can be relieved, so that durability of the counter pressure member will be improved. As the rotary support portion is configured to form the fitting protrusion, and the outer peripheral surface of the rotary support portion is configured to be a curved surface forming a part of the pipe-receiving groove of half-circular cross section, the counter pressure member can be formed as a single part with an appropriate shape. Particularly, if the second groove part of half-circular cross section of the body portion of the counter pressure member forms an obtuse angle with a side surface of an end portion of the second groove part formed next to the curved surface portion, a good durability can be ensured. Furthermore, if the counter pressure member is configured to comprise at least a first member and a second member, the rotary support portion constituting a main part of the first member, and the body portion constituting a main part of the second member, the counter pressure member being formed by combining the first member and the second member, when the rotary support portion is worn, only the first member may be changed, so that not only the changing work will be made easily, but also a cost down can be achieved from a long term viewpoint.

On the other hand, if the bend die is configured by an upper section and a lower section divided by a surface perpendicular to the rotary axis, and the fitting protrusion of the counter pressure member is disposed between the upper section and the lower section, although number of parts will be increased comparing the aforementioned configurations, each part can be manufactured with a particular accuracy as required in accordance with a performance of each part, so that each part can be manufactured easily.

In the pipe bend die unit as described above, if the counter pressure member is configured to be divided into at least two members, and it is configured that the at least two members are a mating member including the fitting protrusion and a rotary support member supported to be rotatable about the rotary axis, and that the mating member is detachably connected to the rotary support member, then, only the mating member can be changed as required, so that a countermeasure against its wearing can be made easily. In the case where the clamp member and the counter pressure member comprise a plurality of members divided by a plurality planes perpendicular to the rotary axis, and the plurality of members are configured to be stacked to form the clamp member and the counter pressure member, the clamp member and counter pressure member can be configured by stacking the plurality of parts, and a hinged connection between them can be configured at the same time. If a knock pin fixed to a predetermined position of the clamp member is further comprised, and a position where the counter pressure member abuts on the knock pin is provided for an initial relative position between the clamp member and the counter pressure member, then, the pipe bend die unit, wherein the initial relative position between the clamp member and the counter pressure member is set in advance, can be provided.

And, a pipe bending apparatus according to the present invention comprises the pipe bend die unit configured as described before, a clamp die for clamping the pipe to be bent with the pipe-receiving groove of its bend die, and a pressure die for pressing the pipe toward the bend die, and it is so configured that bending of the pipe is performed by rotating the bend die and the clamp die, with the pipe being pressed in the bending direction by the pressure die. Therefore, the bending of the pipe can be achieved appropriately without causing the crinkling. Furthermore, if a plurality of pipe bend die units are prepared in accordance with various shapes of pipes to be bent, when a pipe is to be bent in a shape, a pipe bend die unit for the shape to be bent may be simply selected and changed, so that the die change can be performed easily, and that no adjustment is required after the die change. Therefore, an automatic die change by means of a robot can be made.

In the pipe bending apparatus as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, smooth bending of the pipe can be achieved.

Particularly, if the counter pressure member has a circularly recessed portion forming the first groove part of half-circular cross section, the fitting recess extending in a peripheral direction on a planar surface perpendicular to the rotary axis, the fitting recess being located at a bottom center of the circularly recessed portion, the first groove part of half-circular cross section being continuous with the circularly recessed portion including a part of the fitting recess, and that the counter pressure member includes a curved surface portion formed on opposite sides of the planar surface, the curved surface portion being configured to contact the circularly recessed portion, the curved surface portion possessing an arch center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis, next to the curved surface portion, then, the tip end portion of the curved surface portion of the counter pressure member at the initial position for bending the pipe tightly contacts the circularly recessed portion of the clamp member, whereas a clearance is formed between the curved surface portion of the counter pressure member and the circularly recessed portion at other portions than the tip end portion, even if the relative rotational angle between the clamp member and the counter pressure member is changed. Therefore, the counter pressure member can be assembled with the clamp member easily and appropriately, without causing an interference with the circularly recessed portion, and a durability of the counter pressure member will be improved.

If the counter pressure member served for the pipe bending apparatus as described above has an annular rotary support portion mounted to be rotatable about the rotary axis, and a body portion formed integrally with the rotary support portion, and formed with the groove of half-circular cross section and the curved surface portion, with a part of the rotary support portion formed integrally with the body portion being formed to extend outwardly in a radial direction of the rotary support portion, it can be surely supported to be rotatable about the rotary axis, and it can be hingedly connected with the clamp member easily. In addition, as a part of the rotary support portion is formed to extend outwardly in a radial direction of the rotary support portion, stress concentration applied to the rotary support portion can be relieved, so that durability of the counter pressure member will be improved. As the rotary support portion of the counter pressure member is configured to form the fitting protrusion, and the outer peripheral surface of the rotary support portion is configured to be a curved surface forming a part of the pipe-receiving groove of half-circular cross section, the counter pressure member can be formed as a single part with an appropriate shape.

Furthermore, if the counter pressure member is configured to comprise at least a first member and a second member, the rotary support portion constituting a main part of the first member, and the body portion constituting a main part of the second member, the counter pressure member being formed by combining the first member and the second member, when the rotary support portion is worn, only the first member may be changed, so that not only the changing work will be made easily, but also cost down can be achieved from a long term viewpoint. Also, if the counter pressure member and the clamp member are hingedly connected by an axial member having a central axis passing through the fitting recess, smooth bending of the pipe can be achieved without causing the crinkling.

Furthermore, if the bend die is configured by an upper section and a lower section divided by a surface perpendicular to the rotary axis, and the fitting protrusion of the counter pressure member is disposed between the upper section and the lower section, each part can be manufactured with a particular accuracy as required in accordance with a performance of each part, so that each part can be manufactured easily.

In the pipe bending apparatus as described above, if a knock pin fixed to a predetermined position of the clamp member is further comprised, and a position where the counter pressure member abuts on the knock pin is provided for an initial relative position between the clamp member and the counter pressure member, then, the pipe bend die unit, wherein the initial relative position between the clamp member and the counter pressure member is set in advance, can be provided, and no adjustment after the die change is required. Furthermore, if there is provided a mandrel with a tip end portion thereof being inserted into the pipe, to be driven such that the tip end portion opposes the pressure die within a predetermined rotating region of the bend die, bending work with a small bending radius can be made easily, and limit for bending the pipe can be improved at a large extent.

EMBODIMENTS FOR CARRYING OUT THE INVENTION

Figure 1:
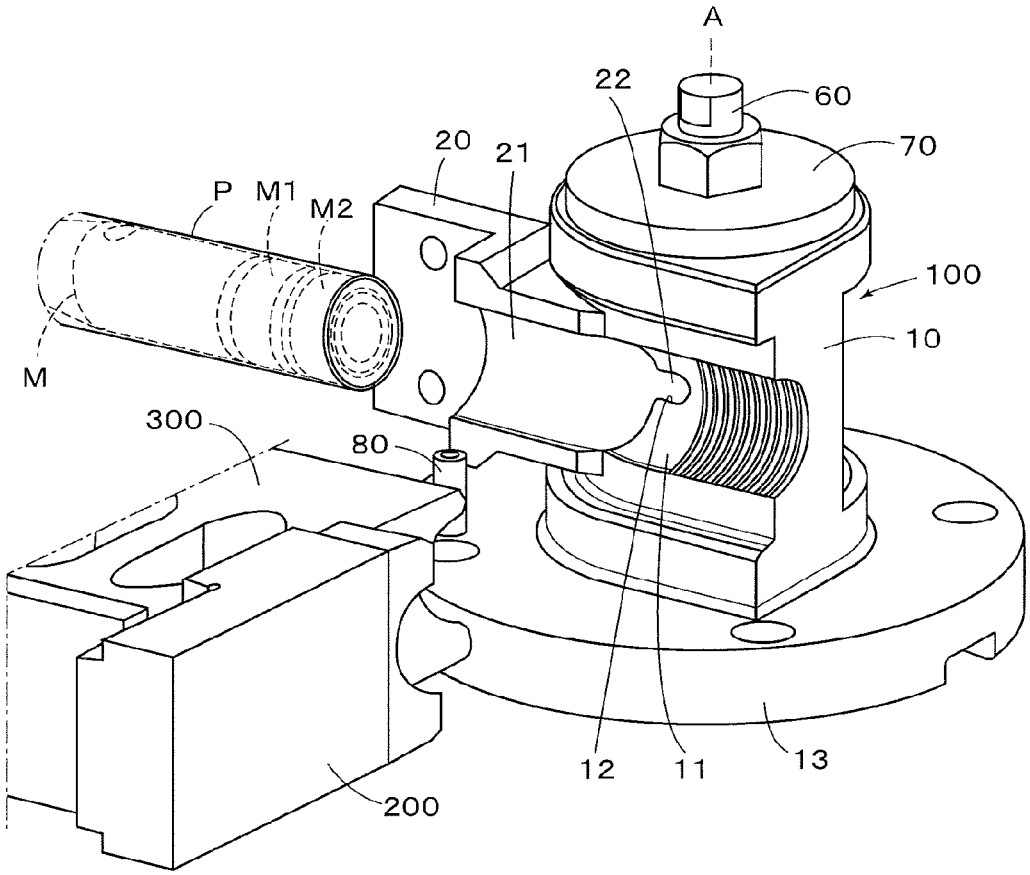
FIG. 1 is a perspective view showing a pipe bending apparatus according to an embodiment of the present invention.

Hereinafter, will be explained desirable embodiments of the present invention referring to drawings. FIG. 1 shows a pipe bend die unit according to an embodiment of the present invention, and shows a pipe bending apparatus further comprising a clamp die 200 and a pressure die 300 according to an embodiment of the present invention. The pipe bend die unit has a bend die 100, which is formed with a pipe-receiving groove of half-circular cross section (configured by first and second groove parts 11, 21 as will be described later), and which is rotated about a rotary axis (A). And, according to the pipe bending apparatus, it is so configured that a pipe (P) to be bent is clamped between the bend die 100 and the clamp die 200, and forwardly driven with being pressed toward the bend die 100 by the pressure die 300, thereby to bend the pipe (P) by means of compressing load and axially pressing load. Although a mechanism for applying the axially pressing load to the pipe (P) to be forwardly driven is omitted in FIG. 1, the mechanism is indicated by a reference (1*a*) shown in FIGS. 42-45 as will be described later.

Figure 2:
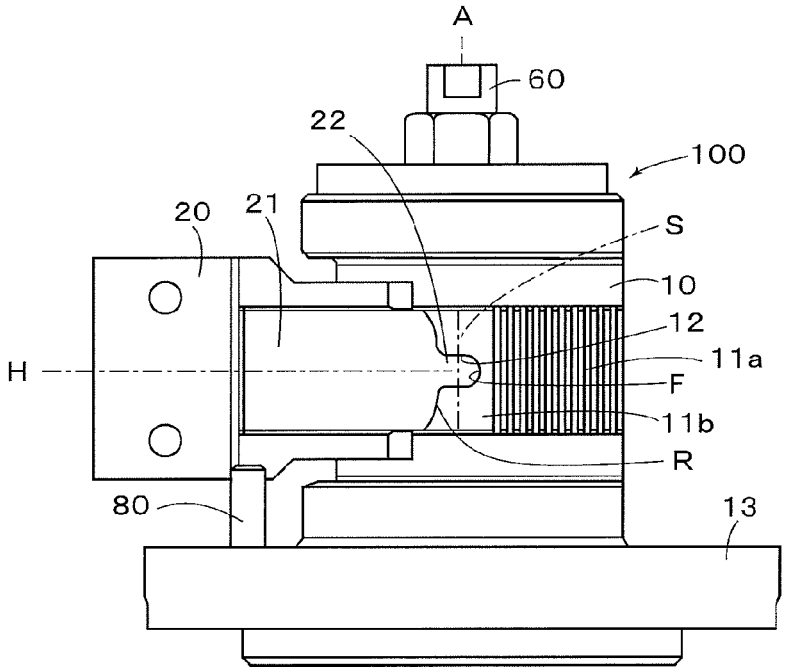
FIG. 2 is a front view of a pipe bend die unit according to an embodiment of the present invention.

According to the present embodiment, the bend die 100 has a clamp member 10 and a counter pressure member 20. As shown in FIGS. 1 and 2, the clamp member 10 is formed with the first groove part 11 of half-circular cross section, and a fitting recess 12 of a predetermined width is formed on the first groove part 11 to extend in a peripheral direction by a first predetermined length on a planar surface perpendicular to the rotary axis (A). And, the clamp member 10 is formed integrally with a base portion 13, to which an axial member 60 is fixed so as to provide the rotary axis (A), and a holding member 70 is fixed to the clamp member 10. Furthermore, a knock pin 80 is fixed to a predetermined position of the base portion 13, as will be described later.

Figure 6:
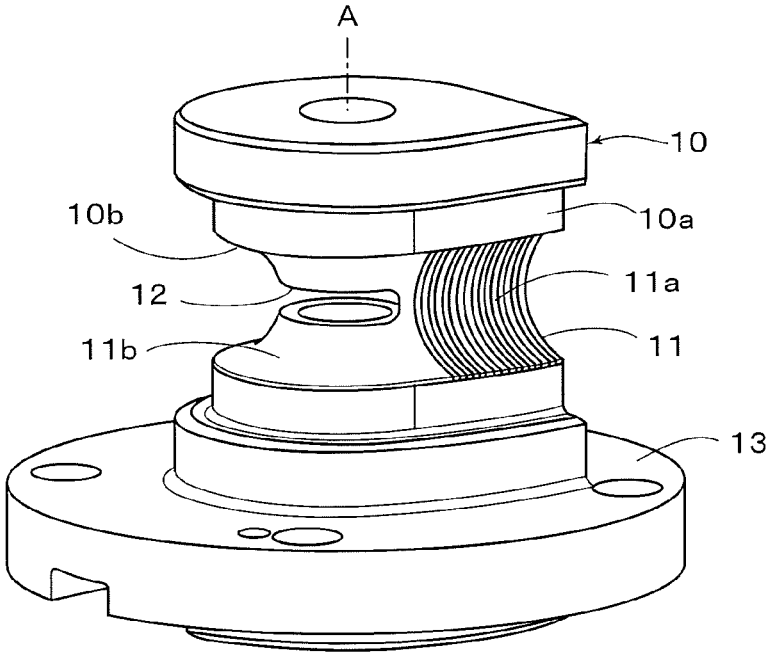
FIG. 6 is a perspective view showing a clamp member for use in a pipe bend die unit according to an embodiment of the present invention.
Figure 7:
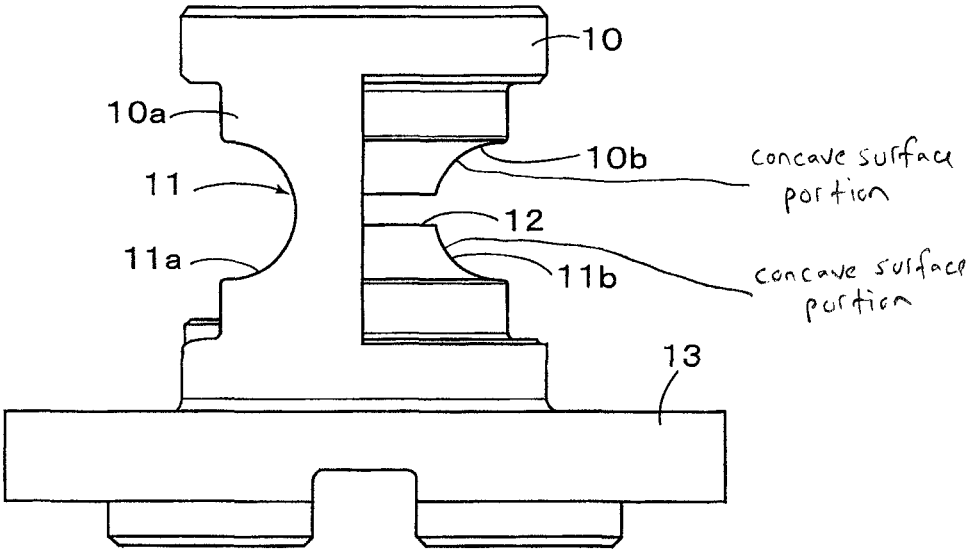
FIG. 7 is a side view of a clamp member for use in an embodiment of the present invention.

As shown in FIGS. 6 and 7, the above-described clamp member 10 has a circularly recessed portion 10*b* to form the first groove part 11 of half-circular cross section, and the fitting recess 12 extending in a peripheral direction on a planar surface perpendicular to the rotary axis (A). The fitting recess 12 is located at the bottom center of the circularly recessed portion 10*b*. The first groove part 11 of half-circular cross section is continuous with the circularly recessed portion 10*b* including a part of the fitting recess 12. That is, the clamp member 10 has a clamp portion 10*a*, with a planar surface of the clamp portion 10*a* connected to the clamp die 200, and the circularly recessed portion 10*b* formed continuously next to the clamp portion 10*a*, and a base portion 13 is formed integrally with the clamp portion 10*a* and the circularly recessed portion 10*b*.

Accordingly, the first groove part 11 possesses a continuous half-circular cross section, with a groove part 11*a* of half-circular cross section formed on the clamp portion 10*a* and a groove part 11*b* of half-circular cross section formed on the circularly recessed portion 10*b*. Furthermore, on the groove part 11*a*, a plurality of clamp grooves are formed peripherally to ensure holding the pipe (P), in the same manner as the inner peripheral surface of the clamp die 200. And, on a central portion (axial central portion) of the first groove part 11, the fitting recess 12 is formed to extend from a portion next to the groove part 11*a* by about 270 degree in a peripheral (circumferential) direct ion of the groove part 11*b*. Although the camp member 10 of the present embodiment is formed integrally with the bend die 100 as a part of the bend die 100, it may be made separately and connected to the bend the 100, as described later with reference to FIGS. 15-18.

Figure 3:
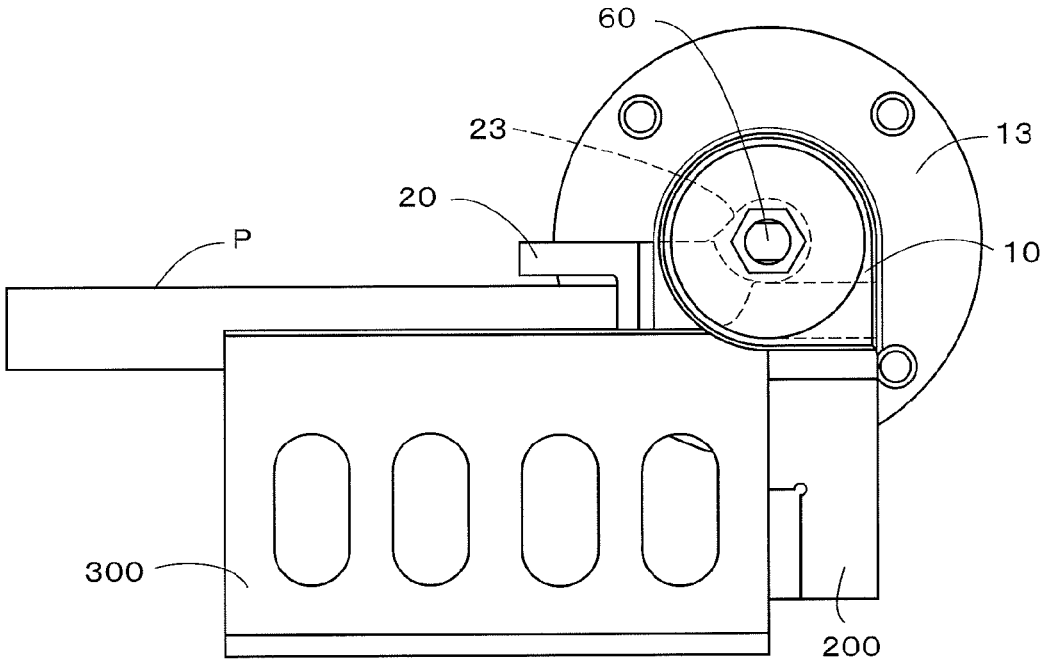
FIG. 3 is a plan view of a pipe bending apparatus showing its starting state of a bending operation according to an embodiment of the present invention.

On the other hand, as shown in FIGS. 1 and 2, the counter pressure member 20 is formed with the second groove part 21 of half-circular cross section on its outer peripheral surface, and a fitting protrusion 22 extending in a peripheral direction by a predetermined length from a tip end portion of the second groove part 21. When the fitting protrusion 22 is positioned in the fitting recess 12, the pipe-receiving groove of half-circular cross section is formed by the combination of the first groove part 11 of the clamp member 10 and the second groove part 21 of the counter pressure 20. As shown in FIG. 3, the counter pressure member 20 has a rotary support portion 23, which is rotatably supported by the axial member 60 (rotary axis (A)), and a part of the rotary support portion 23 configures the fitting protrusion 22. Therefore, the outer peripheral surface of the rotary support portion 23 is formed into a curved surface, to form the pipe-receiving groove of half-circular cross section, together with the first groove part 11 of the clamp member 10.

The above counter pressure member 20 is formed as shown in FIGS. 8-14. That is, a curved surface portion (counter pressure portion) 20*a* positioned to be capable of contacting the circularly recessed portion 10*b* and the rotary support portion 23 rotatably supported about the rotary axis (A) are formed integrally, and a part of the rotary support portion 23 configures the fitting protrusion 22. Therefore, the outer peripheral surface of the rotary support portion 23 is formed into a curved surface, to form the pipe-receiving groove of half-circular cross section, together with the first groove part 11 of the clamp member 10. That is, the counter pressure member 20 is formed with a second groove part 21 of half-circular cross section, and the end surface of the second groove part 21 contacting the first groove part 11 of the clamp member 10 is formed to be curved according to its front view, as indicated by a contacting portion (R) in FIG. 2. Although the curved surface portion 20*a* is formed with its thickness being gradually reduced, it is not continuously made extremely thin, because it is integrally formed with the rotary support portion 23 at a portion where the fitting protrusion 22 is extended, thereby to ensure a sufficient strength.

And, an outer peripheral surface 22*a* of the fitting protrusion 22, i.e., the outer peripheral surface of the rotary support portion 23 is formed into a curved surface as shown in FIGS. 8 and 10-14. When the fitting protrusion 22 is fitted into the fitting recess 12 of the clamp member 10, thereby to form a part of the half-circular cross section of the first groove part 11 of the clamp member 10, the pipe-receiving groove of half-circular cross section is formed by them. The rotary support portion 23 of the present embodiment is made in an annular shape, while it may be made in C-shape, with a portion except for the fitting protrusion 22 being cut out to provide a space.

The clamp member 10 and counter pressure member 20 as configured above are hingedly connected about the rotary axis (A), and rotatably supported relative to each other about the axial member 60 (rotary axis (A)). According to the present embodiment, the clamp member 10 is supported to be rotated against the counter pressure member 20, which is fixed to a predetermined position of a support device (not shown). As shown in FIG. 2, the clamp member 10 and the counter pressure member 20 are hingedly connected, such that a fitting portion (F) of the fitting protrusion 22 that is fitted in the fitting recess 12, which portion (F) is not included on planar surfaces perpendicular to the rotary axis (A), i.e., two planar surfaces parallel to the plane perpendicular to the paper surface of FIG. 2 including (H) shown in FIG. 2, is located at a foreside (right side of (S) in FIG. 2) in an advancing direction of the pipe (P) relative to an initial position (indicated by a vertical one-dotted chain line (S) in FIG. 2) where a bending operation of the pipe (P) is initiated, and a mating portion (R) of the first groove part 11 of the clamp member 10 and the second groove part 21 of the counter pressure member 20 in a rotating direction is located at a backside (left side of (S) in FIG. 2) of the advancing direction of the pipe (P). In other words, the fitting portion (F) of the fitting protrusion 22 fitted into the fitting recess 12 in a rotating direction is located at the foreside in an advancing direction of the pipe (P) relative to the position where the bending operation of the pipe (P) is initiated, and the mating portion (R) of the first groove part 11 of the clamp member 10 and the second groove part 21 of the counter pressure member 20 in the rotating direction is located at a backside of the advancing direction of the pipe (P) relative to the position where the bending operation of the pipe is initiated.

Consequently, with the fitting protrusion 22 of the counter pressure member 20 being fitted into the fitting recess 12 of the clamp member 10, the axial member 60 configuring the rotary axis (A) is inserted through the rotary support portion 23 to be fixed to the base member 13, and fixed to the holding member 70, thereby to configure the bend die 100 as shown in FIG. 1. Furthermore, a knock pin 80 is fixed to a predetermined position of the base portion 13 of the clamp member 10, so that an initial relative position between the clamp member 10 and the counter pressure member 20 is provided by a position where the counter pressure member 20 abuts on the knock pin 80. On the other hand, the clamp die 200 and the pressure die 300 are arranged as shown in FIG. 1, and disposed to be close to or away from the bend die 100, respectively.

As shown in FIGS. 1 and 2, as the pipe bend die unit is configured by the bend die 100 with the clamp member 10 and the counter pressure member 20 placed at the initial relative position, if a plurality of pipe bend die units are provided for various shapes of the pipes (P) to be bent, in case of bending the various shapes of pipes, it is only required to select and change the bend die unit for the shape of the pipe to be bent, so that a so-called die change can be made easily. Particularly, as the initial relative position between the clamp member 10 and counter pressure member 20 can be set by the knock pin 80 in advance, no adjustment after the die change is required, so that it can be adjusted easily without any skilled technique. In addition to the pipe bend die unit as described above, if an assembly is configured by further comprising the clamp die 200 and pressure die 300, it is possible to provide a pipe bend die assembly for performing the die change and adjustment easily.

Figure 4:
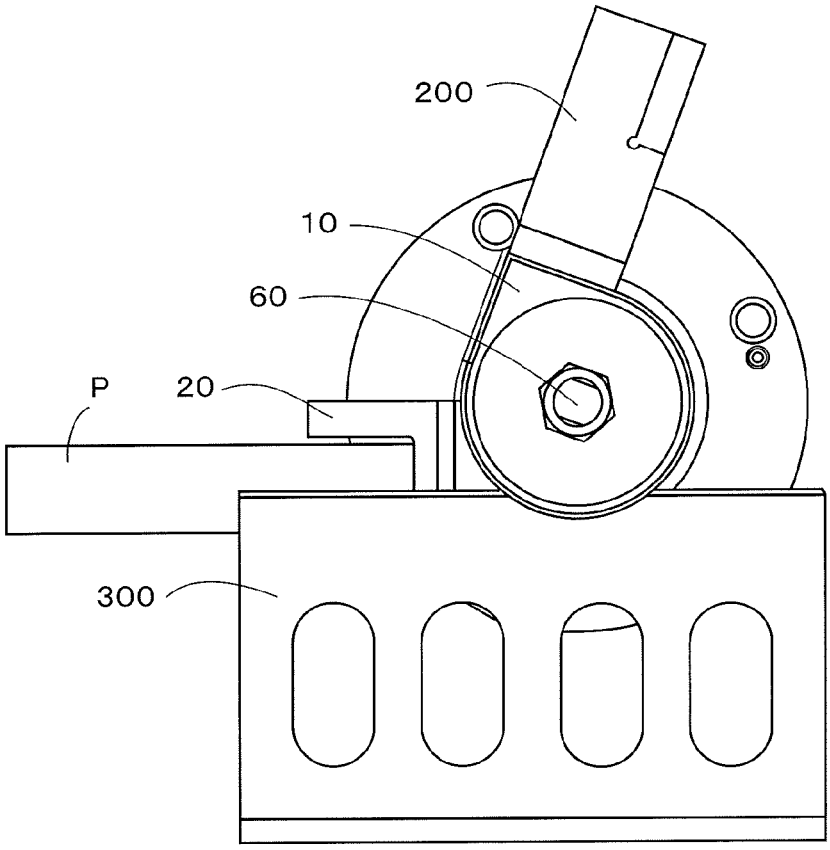
FIG. 4 is a plan view of a pipe bending apparatus showing its finishing state of a bending operation according to an embodiment of the present invention.
Figure 5:
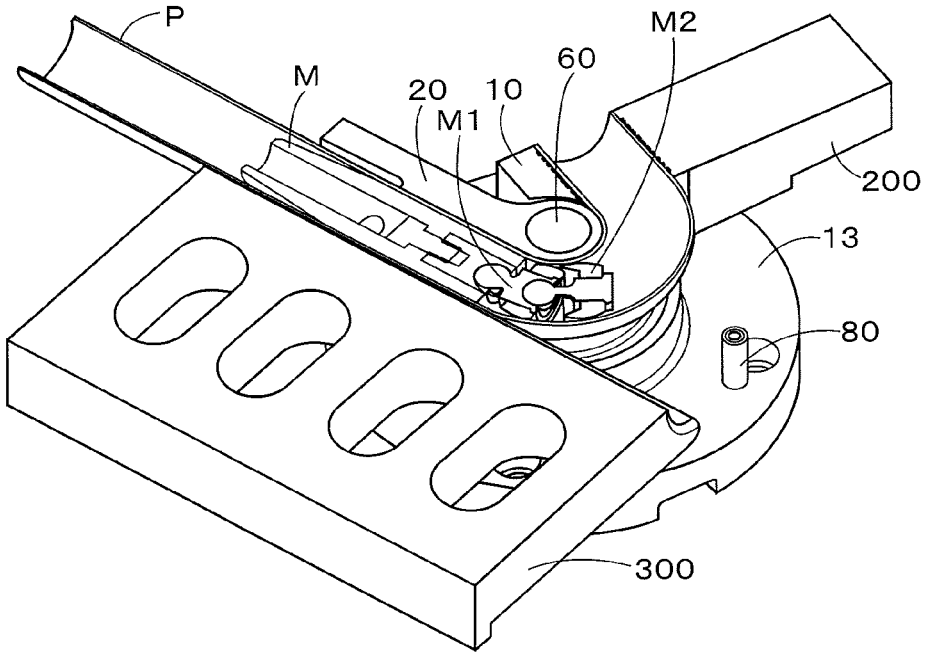
FIG. 5 is a perspective sectional view of a pipe bending apparatus showing its finishing state of a bending operation according to an embodiment of the present invention.

Referring to FIGS. 1-5, the overall operation of the pipe bending apparatus having the pipe bend die unit as described above will be explained hereinafter. At the outset, with the counter pressure member 20 being held at the initial relative position to contact the knock pin 80, a portion to be bent of the body portion of the pipe (P) is placed at the bend starting position as indicated by (S) in FIG. 2 of the bend die 100, a known mandrel as indicated by (M) in FIGS. 1 and 5 is inserted into the pipe (P). The mandrel (M) has balls (M1) and (M2) pivotally mounted on its tip end portion, as its cross sectional view is shown in FIG. 5, where a hutching is omitted to define each part clearly. The balls (M1) and (M2) are inserted into the pipe (P), and driven to be disposed between the bend die 100 and the clamp die 200 (and pressure die 300) within a predetermined rotating region of the bend die 100. Next, the clamp die 200 and pressure die 300 are driven toward the bend die 100, the tip end portion of the pipe (P) is clamped between the clamp member 10 of the bend die 100 and the clamp die 200, and the body portion of the pipe (P) is compressed between the counter pressure member 20 of the bend die 100 and the pressure die 300, as shown in FIG. 3.

Then, with the tip end portion of the pipe (P) being clamped between the clamp member 10 and the clamp die 200, the pipe (P) is forwardly driven, with the body portion of the pipe (P) being pressed to the counter pressure member 20 by the pressure die 300, and also the clamp die 200 and the clamp member 10 are rotated about the rotary axis (A), so that the pipe (P) is bent to be rolled around the outer peripheral surface of the rotary support portion 23 (the outer peripheral surface 22*a* of the fitting protrusion 22), thereby to form the pipe (P) bent in such a shape as shown in FIGS. 4 and 5. During this operation, a large pressure is applied to the pipe (P) in its longitudinal direction and radial direction. With the pipe bend die unit according to the present embodiment being employed, however, the inner side wall of the bent pipe (P) is prevented from being thickened due to its compressed deformation, and the outer side wall of the bent pipe (P) is thickened and prevented from being thinned, so that an appropriate thickness of the pipe wall can be maintained even at the bent portion.

As described before, the bend die 100 served for the pipe bend die unit of the present embodiment comprises the clamp member 10 and counter pressure member 20, which are hingedly connected about the rotary axis (A), and rotatably supported relative to each other about the rotary axis (A). Therefore, as the pipe (P) is being bent, the clamp member 10 can be rotated relatively to the counter pressure member 20 about the rotary axis (A), with the counter pressure member 20 being pressed by the pressure die 300 through the pipe (P). Consequently, the clamp member 10 is rotated from the initial bending position (as indicated by (S) in FIG. 2) for the pipe (P) in a circumferential direction spaced from the counter pressure member 20.

Then, the counter pressure member 10 and the clamp member 20 are hingedly connected, such that the fitting portion (indicated by (F) in FIG. 2) of the fitting protrusion 22 that is fitted in the fitting recess 12, which portion is not included on planar surfaces perpendicular to the rotary axis (A), is located at the foreside in the advancing direction of the pipe (P) relative to the position (S) where the bending operation of the pipe (A) is initiated, and the mating portion (indicated by (R) in FIG. 2) of the first groove part 11 of the clamp member 10 and the second groove part 21 of the counter pressure member 20 in the rotating direction is located at the backside of the advancing direction of the pipe (A), whereby a step possibly caused between the clamp member 10 and counter pressure member 20 is made small. Therefore, even if relatively large longitudinal load and compressed load comparing with the prior art are applied to the pipe (P), a plastic deformation caused by bending it can be controlled appropriately, which will be described later in detail referring to FIGS. 46-47.

Figure 19:
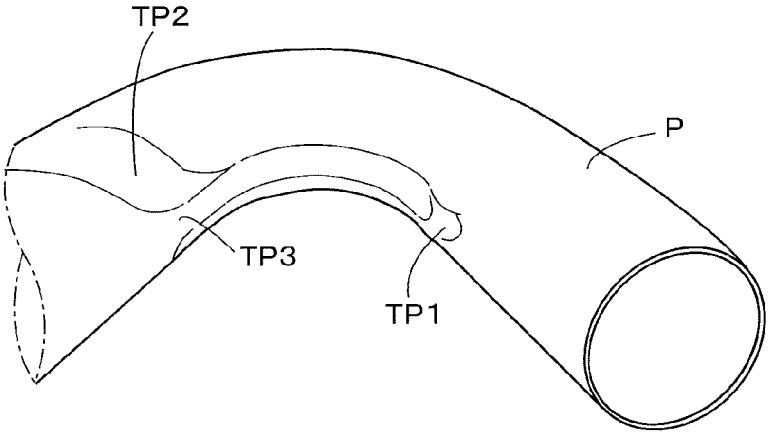
FIG. 19 is a perspective view showing a pipe which was bent by use of a pipe bend die unit according to an embodiment of the present invention.

Consequently, although the pipe (P) which was bent by use of the pipe bend die unit of the present embodiment is formed with a thick portion (protruded portion) as shown in FIG. 19 at a position corresponding to the fitting portion and the fitting protrusion 22, the portions next to the fitting portion will be formed in a smooth curved surface. Practically, thickness of a portion as indicated by a thin line in FIG. 19 is changed gradually, and deformed material is fitted into the fitting portion (indicated by (F) in FIG. 2) to form a thick portion (TP1), and thick portions (TP2 and TP3) along the mating portion (indicated by (R) in FIG. 2). However, the portion as indicated by the thin line in FIG. 19 is formed in a smooth curved surface, so that it does not correspond to the crinkling, and therefore, the thick portions (TP1, TP2 and TP3) will not be created. Rather, the bent pipe with the thick portions (TP1, TP2 and TP3) being formed is proved to be the one which was formed by use of the pipe bend die unit of the present embodiment, to provide a proof of forming quality.

As described above, according to the pipe bending apparatus having the pipe bend die unit of the present embodiment, a smooth bending can be achieved without causing a crinkling. In other words, by appropriately controlling the plastic forming caused by the bending appropriately, the bending of the pipe (P) can be achieved appropriately without causing the crinkling. Consequently, provided that a diameter of a pipe (P) is "d" and a bending radius is "r", for example, a pipe (P) with such an extraordinarily small bending radius that "r/d" is smaller than 1 can be easily formed. As an alternative to the aforementioned pipe bending apparatus, it may be so configured that the clamp member 10 is fixed, and that the counter pressure member 20 is rotated about the rotary axis (A).

Furthermore, as for the pipe bend die unit installed on the pipe bending apparatus as described above, if a plurality of pipe bend die units are prepared in accordance with various shapes of pipes to be bent, when a pipe is to be bent in a shape, a specific pipe bend die unit for the shape to be bent may be simply selected and changed, so that its die change can be performed easily. As the clamp member 10 and counter pressure member 20 configuring the pipe bend die unit have been placed at the initial relative position, no adjustment is required after the die change. Accordingly, the pipe bend die unit can be used for an automatic pipe bending apparatus, so that an automatic die change can be performed by a robot, which will be described later referring to FIGS. 42-45.

Figure 15:
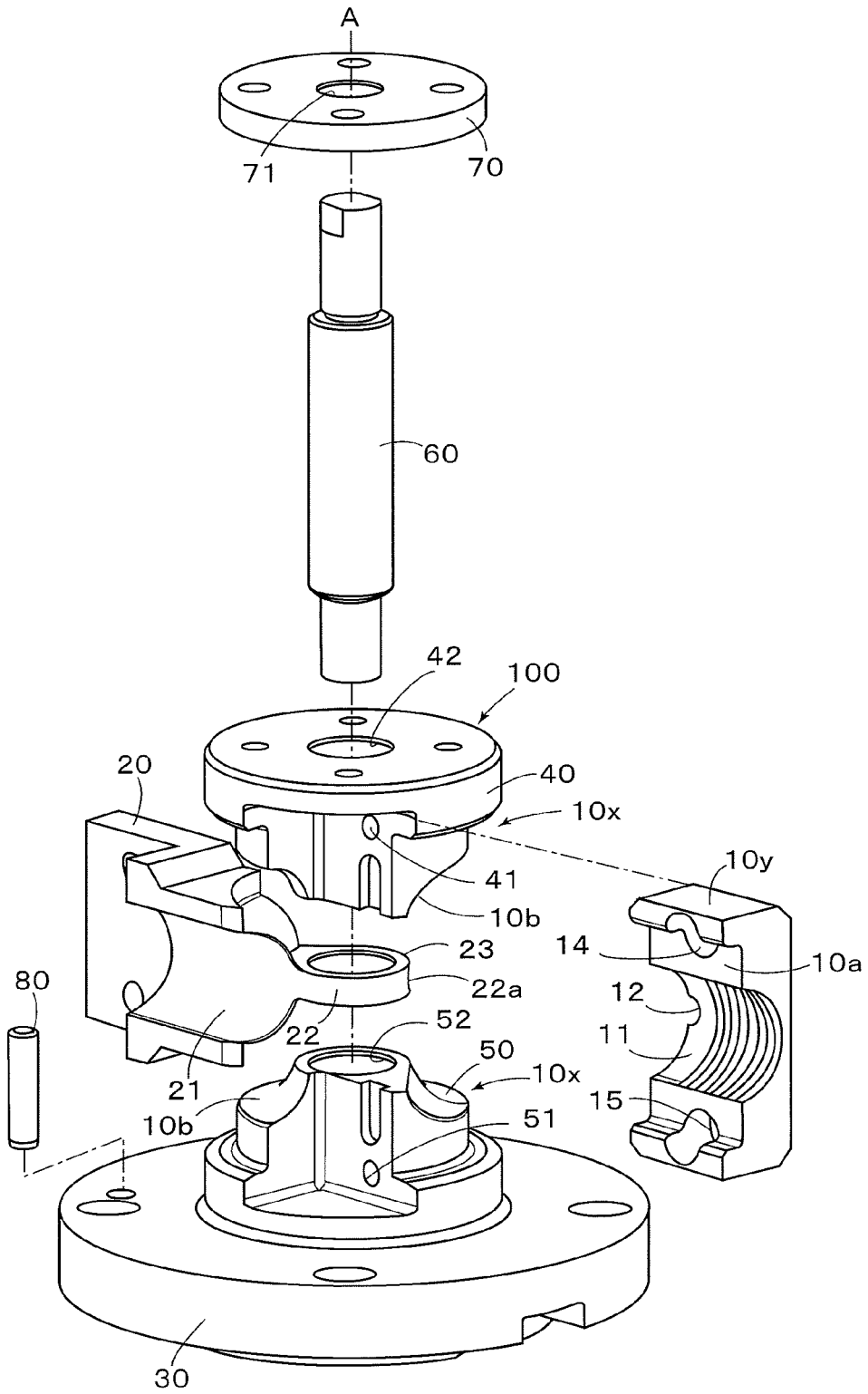
FIG. 15 is a perspective view of parts for assembling a pipe bend die unit according to another embodiment of the present invention.
Figure 16:
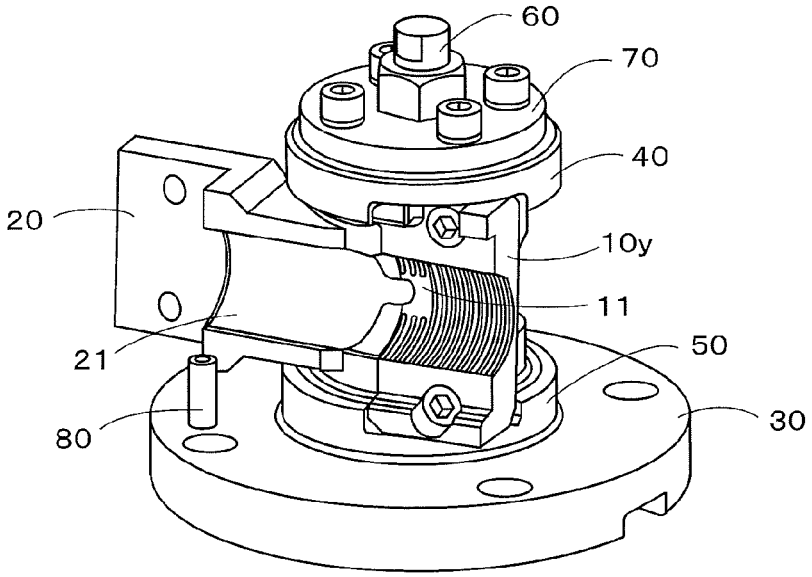
FIG. 16 is a perspective view of a pipe bend die unit according to another embodiment of the present invention.

FIGS. 15-18 relate to another embodiment of the present invention, wherein in contrast to the clamp portion 10*a* that is formed integrally with the clamp member 10, the portion forming the clamp portion 10*a* is made as a separate body (indicated by "10*y*" in FIG. 15 and so on), and connected to a main body 10 (indicated by "10*x*" in FIG. 15 and so on) configuring the circularly recessed portion 10*b*. For example, as shown in FIG. 15, the main body 10*x* is configured by an upper section 40 and a lower section 50, which are divided by a surface perpendicular to the rotary axis (A), and connected to the separate body 10*y*, thereby to configure the clamp member 10. That is, the axial member 60 is disposed to penetrate a center hole 42 of the upper section 40, the rotary support portion 23 of the counter pressure member 20 and a center hole 52 of the lower section 50, and, after an upper portion of the axial member 60 is penetrated through a center hole 71 of the holding member 70, the holding member 70 is fixed to the upper section 40, thereby to be in such an assembled state as shown in FIG. 16. The clamp portion 10*y* is fixed to the main body 10*x* (the upper section 40 and lower section 50), with screws (not shown) being inserted from fixing holes 14 and 15, and meshed with screw holes 41 and 51 of the upper section 40 and lower section 50. With respect to other configuration, it is the same as the aforementioned embodiment, so that its explanation is omitted herein, with the same reference numerals given to substantially the same members as described before.

Figure 17:
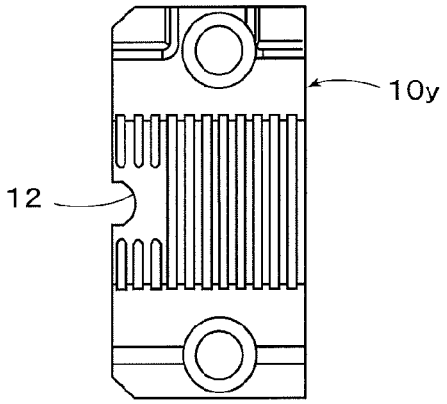
FIG. 17 is a front view of a clamp member for use in another embodiment of the present invention.
Figure 18:
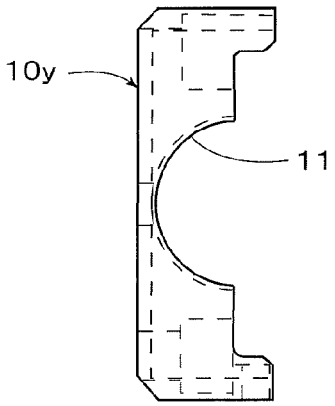
FIG. 18 is a left side view of a clamp member for use in another embodiment of the present invention.

FIGS. 17 and 18 illustrate the separately made clamp portion 10*y*, the first groove part 11 and fitting recess 12 of which are formed in the same shapes as those of the clamp member 10 as shown in FIGS. 1 and 2. That is, the half-circular cross section of the first groove part 11 is formed in the same shape as the half-circular cross section of the second groove part 21 of the counter pressure member 20, so that the first groove part 11 and second groove part 21 form the pipe-receiving groove of a continuous half-circular cross section. And, the fitting protrusion 22 of the counter pressure member 20 is positioned in the fitting recess 12, so that they can smoothly contact the outer peripheral surface of the pipe (P) to be bent.

According to the embodiment as shown in FIGS. 15-18, therefore, the clamp member 10 is configured by the main body 10*x*, which is configured by the upper section 40 and lower section 50, and the clamp portion 10*y*. The fitting recess 12 is configured by a cutout portion of the clamp portion 10*y*, and a clearance between the upper section 40 and lower section 50. With the fitting protrusion 22 of the counter pressure member 20 being positioned in the fitting recess 12, the bend die 100 is configured. Hereinafter, the clamp member 10 includes the member configured by the main body 10*x* and clamp portion 10*y*, except otherwise described specifically.

FIGS. 20-36 relates to a pipe bend die unit according to a further embodiment of the present invention, wherein the same reference numerals are given to those members corresponding to the members as shown in FIGS. 1-18. According to the present embodiment, the counter pressure member 20 has a curved surface portion 20*a*, which is formed on each of opposite sides of the planar surface that is perpendicular to the rotary axis (A) including the bottom center of the circularly recessed portion 10*b*, i.e., the planar surface including (H) as shown in FIG. 2 and corresponding to the paper surface of FIG. 2 (hereinafter, simply referred to as "planar surface (H)"), and which is configured to contact the circularly recessed portion 10*b*. The curved surface portion 20*a* possesses an arch center on an axis that is offset from the rotary axis (A) perpendicular to the planar surface (H) in a direction spaced from the rotary axis (A). Also, the counter pressure member 20 is formed with the second groove part 21 of half-circular cross section, with the bottom center of the second groove part 21 being provided on the planar surface (H) on its outer peripheral surface, and the fitting protrusion 22 extending in the peripheral direction by a predetermined length from the tip end portion of the second groove part 21. When the fitting protrusion 22 is positioned in the fitting recess 12, the pipe-receiving groove of half-circular cross section is formed by the first groove part 11 of the clamp member 10 and the second groove part 21 of the counter pressure member 20. Hereinafter, will be explained the configuration of the counter pressure member 20 including the rotary support portion 23, with reference to FIG. 20 and so on.

Figure 20:
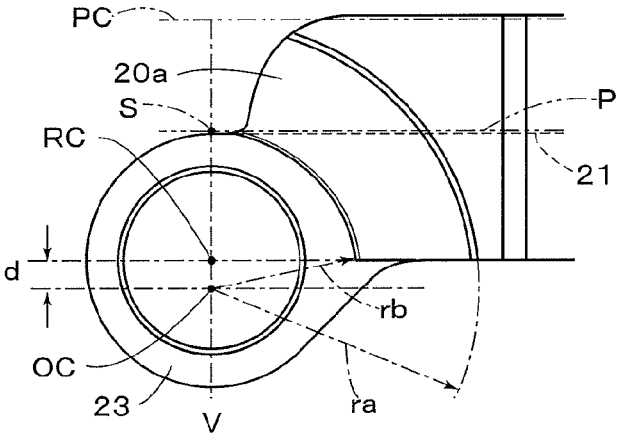
FIG. 20 is a plan view of a counter pressure member for use in a further embodiment of the present invention.

As shown in FIG. 20, the curved surface portion 20*a* is provided on the opposite sides of the above planar surface (H) corresponding to the paper surface of FIG. 20, and its arch center is provided on an axis (OC), which is offset from the rotary axis (A) perpendicular to the planar surface (H) in the direction spaced from the rotary axis (A). The axis (RC) as shown in FIG. 20 corresponds to the rotary axis (A). In FIG. 20, on the second groove part 21 of the half-circular cross section as indicated by a broken line, there is positioned the pipe (P) having a center axis (PC) thereof as indicate by a two-dotted chain line, so that the axis (RC) and axis (OC) are positioned on a one dotted chain line (V) including the initial position (S) for bending the pipe (P) and extending vertically, and that the distance between the axes corresponds to the offset amount (d). In FIG. 20, although only the curved surface portion 20*a* formed at one side relative to the planar surface (H) appears, the other curved surface portion of the same shape with the curved surface portion 20*a* is formed at the other side, i.e., the reverse side of the paper surface of FIG. 20.

Figure 21:
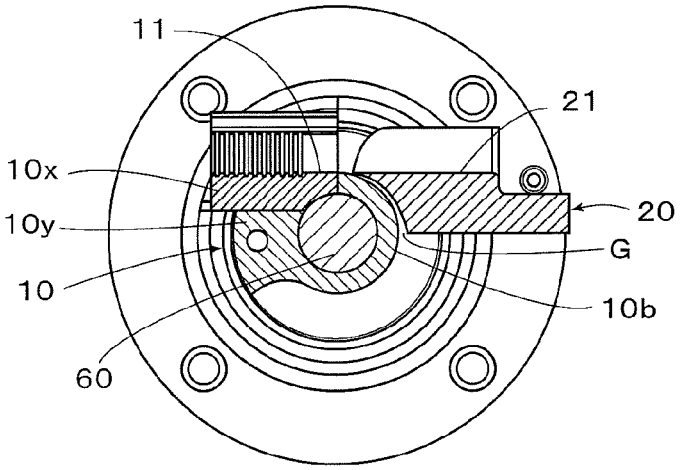
FIG. 21 is a partially sectioned view of a pipe bend die unit showing its starting state of a bending operation according to a further embodiment of the present invention.

Particularly, the curved surface portion 20*a* has a maximum arch of radius (ra) and minimum arch of radius (rb) as shown in FIG. 20, and formed to expand so as to provide the curved surface to be capable of contacting the first groove part 11 of half-circular cross section (at the initial position). That is, as shown in FIG. 21, at the initial position (S) for bending the pipe (P), the fitting protrusion 22 and the curved surface portion 20*a* contact the whole surface of the circularly recessed portion 10*b* (first groove part 11), and at the position remote from the plane (H), a clearance ("G" as shown in FIG. 21) is formed between the curved surface portion 20*a* and the circularly recessed portion 10*b*. FIG. 21 shows a sectional view at the position spaced from the plane (H) by a predetermined distance, i.e., at the position spaced from the plane including the central axis (PC) in FIG. 20 toward the reverse side (downward in FIG. 2), by a predetermined distance.

Accordingly, the tip end portion of the curved surface portion 20*a* of the counter pressure member 20 tightly contacts the circularly recessed portion 10*b* at the initial position (S) for bending the pipe (P), and the clearance (G) is formed between the curved surface portion 20*a* and the circularly recessed portion 10*b*, as described above, at other portions than the tip end portion. As a result, the counter pressure member 20 can be easily and appropriately assembled with the clamp member 10, which is formed by the upper die 40 and lower die 50 in this embodiment, without causing an interference with the circularly recessed portion 10*b*. As the counter pressure member 20 does not slide on the circularly recessed portion 10*b* at other portions than the tip end portion, no frictional loss will be caused, so that a durability of the counter pressure member 20 in particular will be improved. When the curved surface portion 20*a* is formed, it should be avoided to employ any arch center other than the axis (OC) as described above, because otherwise the appropriate contact will not be obtained. For example, if the arch center is positioned on such an axis (not shown) that is perpendicular to the plane (H) and offset in the direction spaced from the rotary axis (A), and also offset in the direction perpendicular thereto, any appropriate clearance will not be provided.

Figure 22:
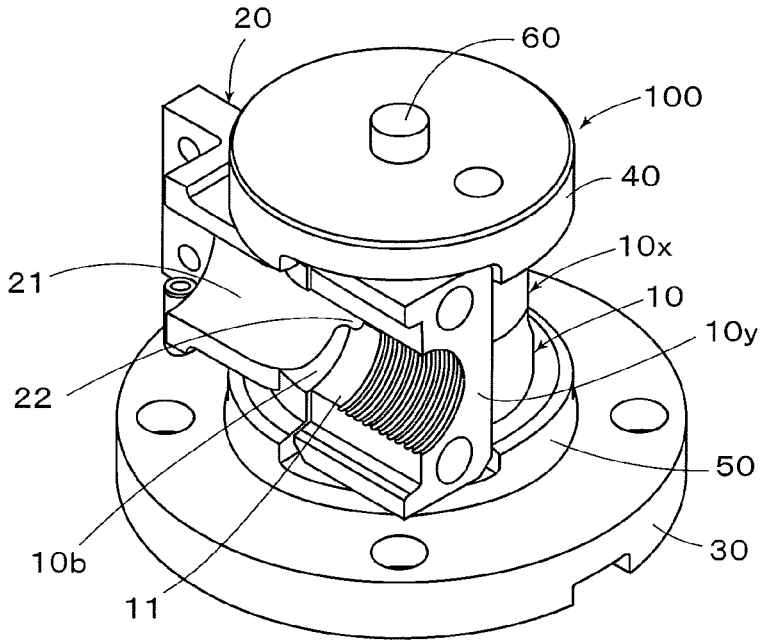
FIG. 22 is a perspective view of a pipe bend die unit showing its starting state of a bending operation according to a further embodiment of the present invention.
Figure 23:
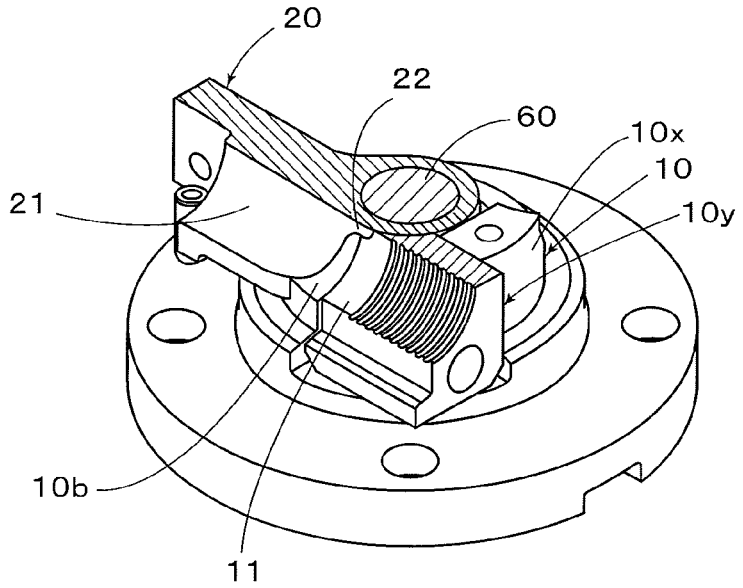
FIG. 23 is a partially sectioned perspective view of a pipe bend die unit showing a sectional view at the center of its groove bottom portion when starting a bending operation according to a further embodiment of the present invention.
Figure 24:
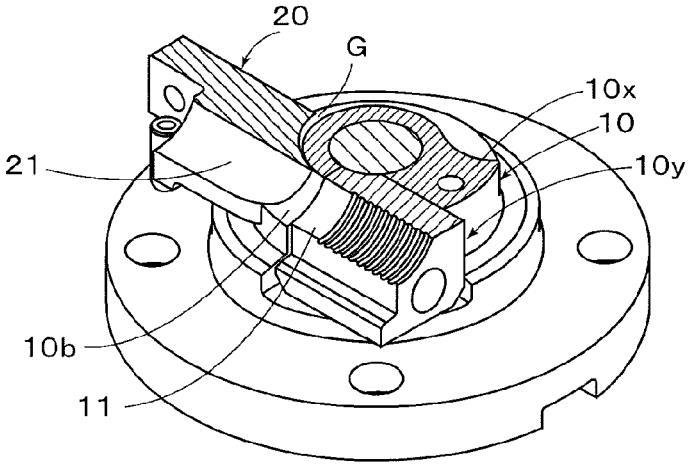
FIG. 24 is a partially sectioned perspective view of a pipe bend die unit showing a sectional view at a position spaced from the center of its groove bottom portion when starting a bending operation according to a further embodiment of the present invention.
Figure 25:
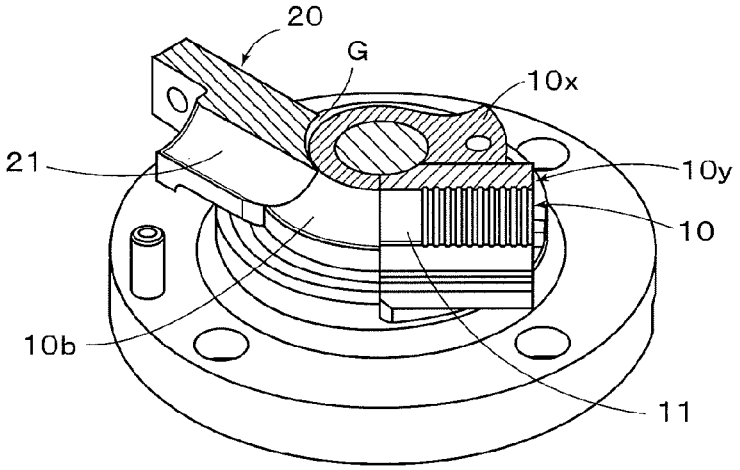
FIG. 25 is a partially sectioned perspective view of a pipe bend die unit showing a sectional view at a position spaced from the center of its groove bottom portion after starting a bending operation according to a further embodiment of the present invention.
Figure 26:
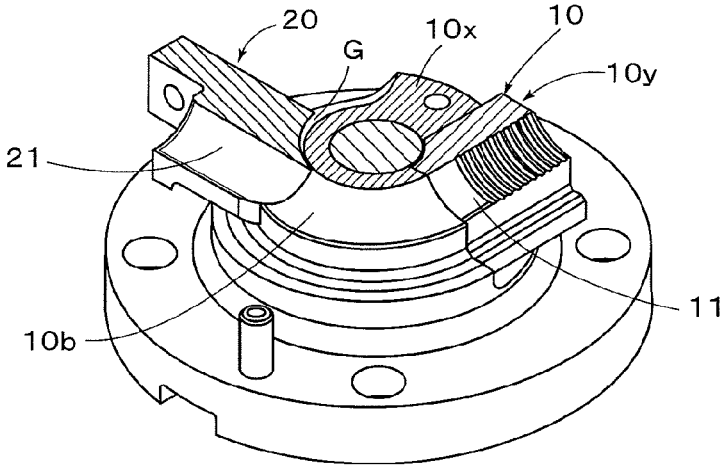
FIG. 26 is a partially sectioned perspective view of a pipe bend die unit showing a sectional view at a position spaced from the center of its groove bottom portion when finishing a bending operation according to a further embodiment of the present invention.

FIGS. 22-26 illustrate the states of relative movement between the clamp member 10 and the counter pressure member 20. FIG. 22 illustrates the initial state, FIG. 23 illustrates the sectional view at the plane (H), and FIGS. 24-26 illustrate the sectional views at the position spaced from the plane (H), i.e., spaced from the plane including the central axis (PC) in FIG. 20 toward the reverse side (downward in FIG. 2), by the predetermined distance. As shown in FIGS. 24-26, even if the relative rotational angle between the clamp member 10 and the counter pressure member 20 is varied, there exists the clearance (G) between the curved surface portion 20*a* of the counter pressure member 20 and the circularly recessed portion 10*b*. Therefore, the counter pressure member 20 can be easily and appropriately assembled into the clamp die 10, without causing the interference with the circularly recessed portion 10*b*, and the durability of the counter pressure member 20 will be improved.

Figure 8:
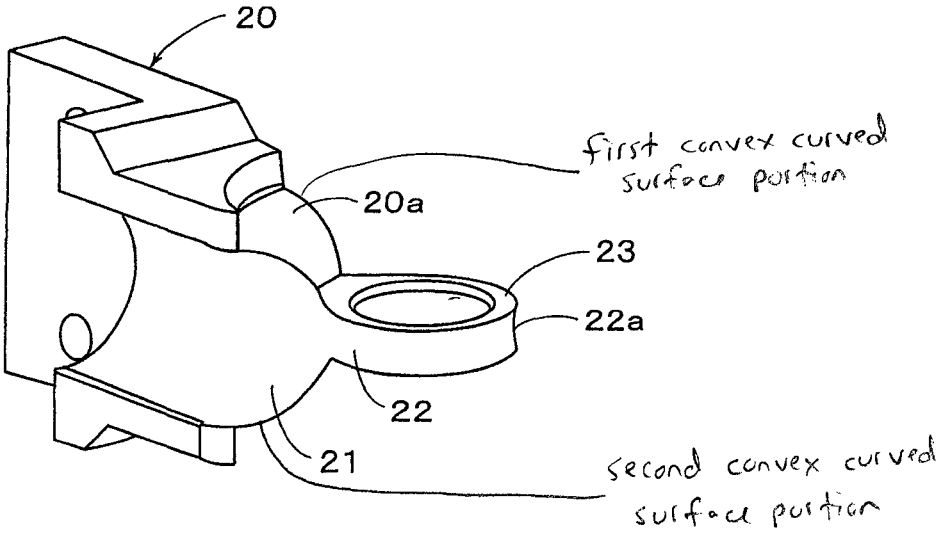
FIG. 8 is a perspective view showing a counter pressure member for use in a pipe bend die unit according to an embodiment of the present invention.
Figure 9:
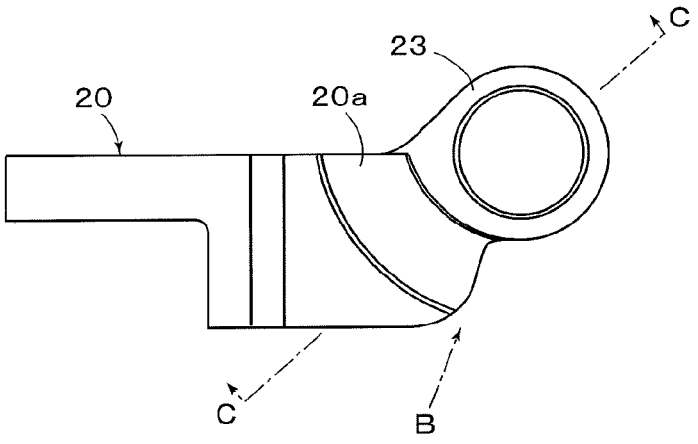
FIG. 9 is a plan view of a counter pressure member for use in an embodiment of the present invention.
Figure 10:
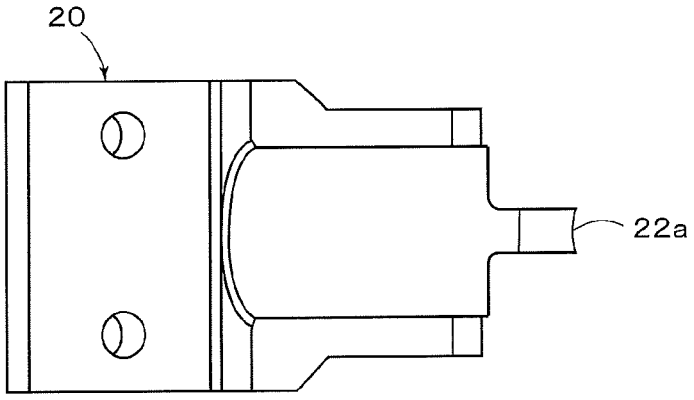
FIG. 10 is a cross sectional view as viewed from "B" in FIG. 9 showing a counter pressure member for use in an embodiment of the present invention.
Figure 11:
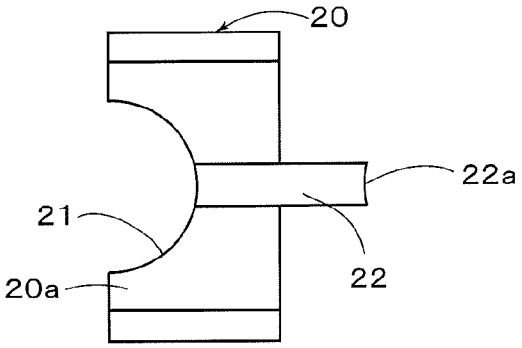
FIG. 11 is a right side view of a counter pressure member for use in an embodiment of the present invention.
Figure 12:
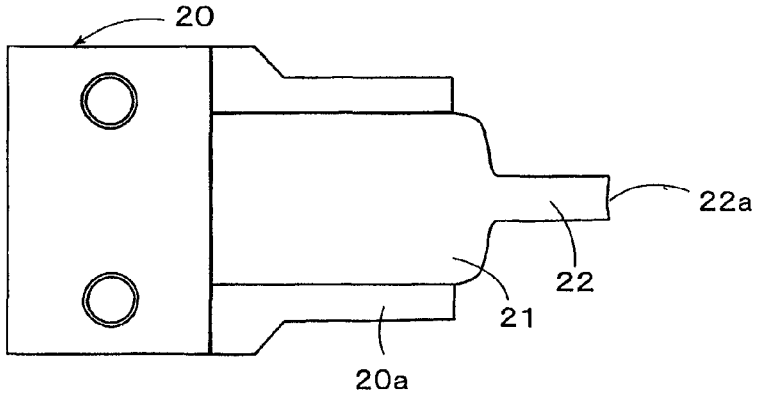
FIG. 12 is a front view of a counter pressure member for use in an embodiment of the present invention.
Figure 13:
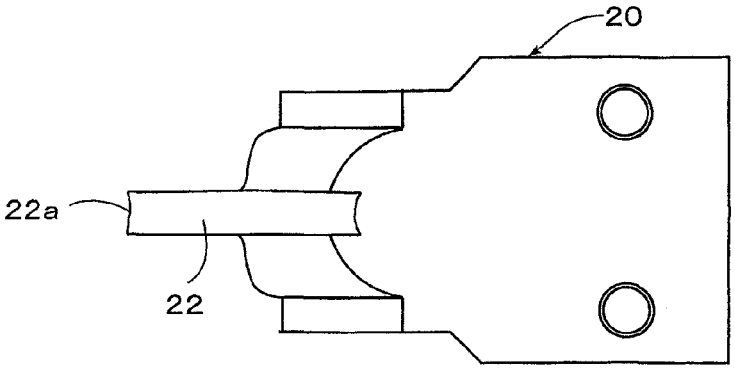
FIG. 13 is a rear view of a counter pressure member for use in an embodiment of the present invention.
Figure 14:
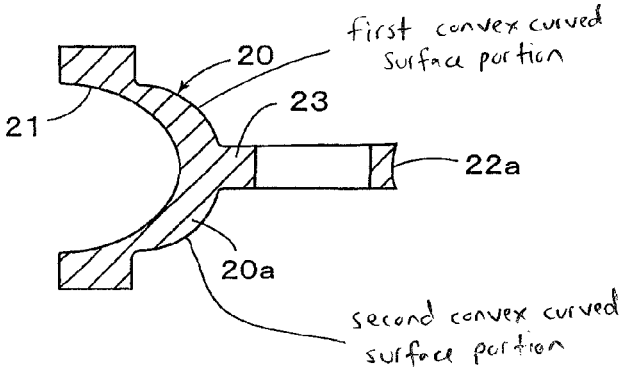
FIG. 14 is a cross sectional view sectioned along C-C line in FIG. 9 showing a counter pressure member for use in an embodiment of the present invention.
Figure 33:
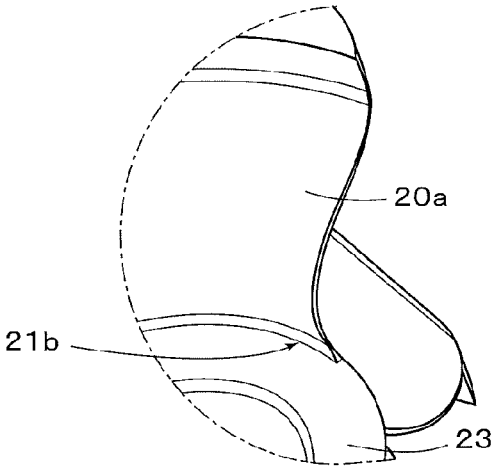
FIG. 33 is a perspective view enlarging a bottom portion of second groove part of a counter pressure member for use in a further embodiment of the present invention.
Figure 34:
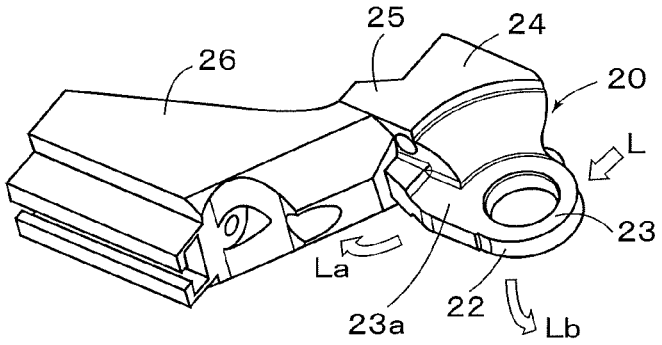
FIG. 34 is a perspective view showing an assembled state of a counter pressure member for use in a further embodiment of the present invention.
Figure 35:
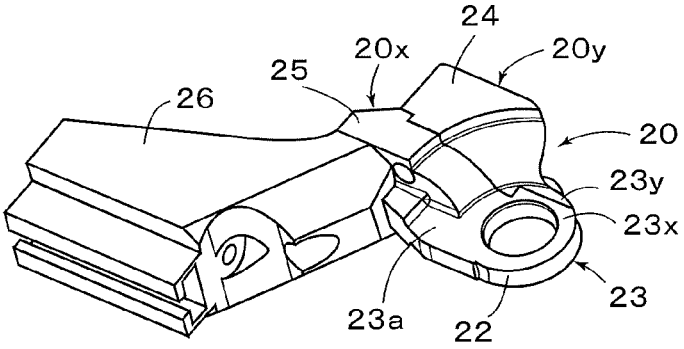
FIG. 35 is a perspective view showing an assembled state of a counter pressure member for use in a yet further embodiment of the present invention.
Figure 36:
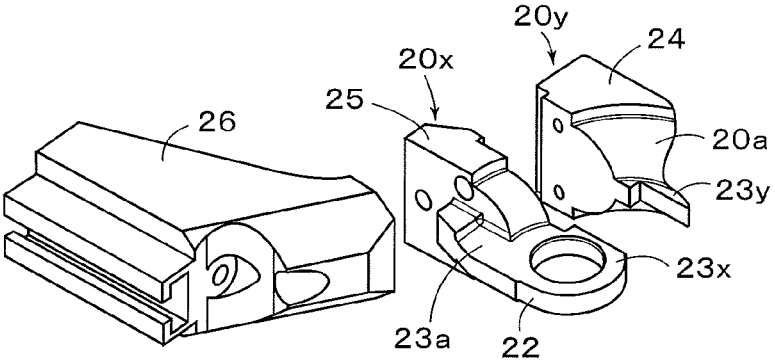
FIG. 36 is a perspective view showing parts for assembling a counter pressure member according to a yet further embodiment of the present invention.

According to the present embodiment, the counter pressure member 20 has a support member 26 as shown in FIG. 34, while it may be formed integrally with the support portion fixed to the aforementioned support device (not shown), as shown in FIG. 8. As shown in FIGS. 27-34, the counter pressure member 20 is integrally formed with a main body portion 24 and connecting portion 25 so as to be connected to the support member 26. As the fundamental configuration of the counter pressure member 20 is the same as that as disclosed in FIGS. 1-26, common reference numerals are used in FIG. 27 and so on, and its overall configuration is indicated as the counter pressure member 20.

Figure 27:
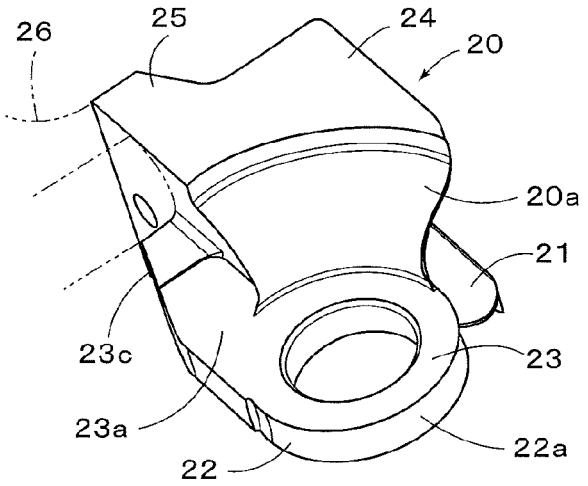
FIG. 27 is a perspective view of a counter pressure member, as viewed from its rotary support portion, for use in a further embodiment of the present invention.
Figure 28:
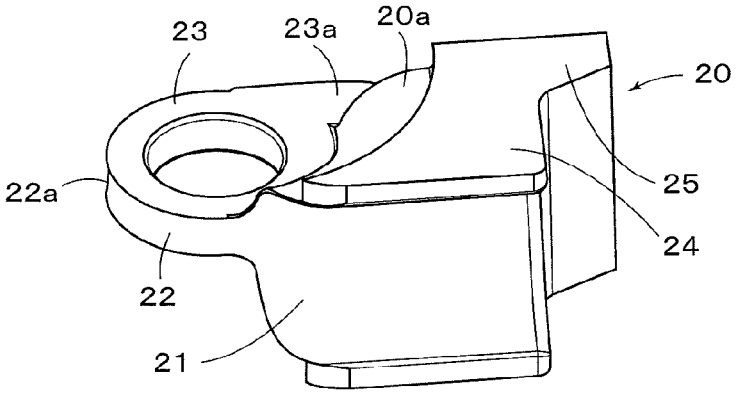
FIG. 28 is a perspective view of a counter pressure member, as viewed from its second groove part, for use in a further embodiment of the present invention.
Figure 29:
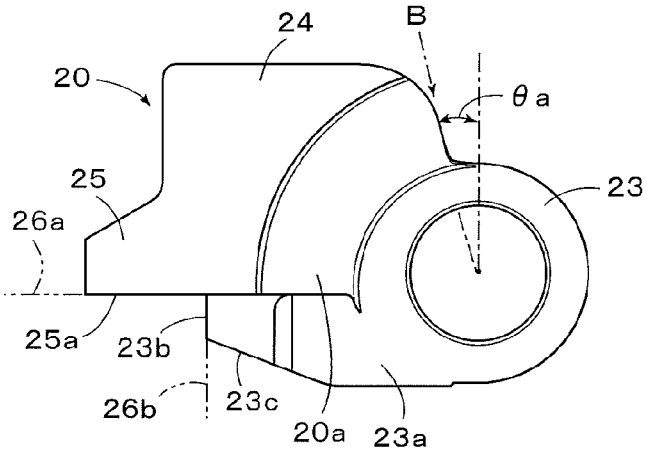
FIG. 29 is a plan view of a counter pressure member for use in a further embodiment of the present invention.

As shown in FIG. 27, the counter pressure member 20 of the present embodiment has the aforementioned rotary support portion 23, and the main body portion 24, which is formed integrally with rotary support portion 23, and formed with the second groove part 21 of half-circular cross section and the curved surface portion 20*a*. And, a rib 23*a* is formed to extend from at least a peripheral part of the rotary support portion 23 integrally formed with the main body portion 24. As shown in FIG. 29, the rib 23*a* is formed to extend in a tangential direction to an annular part of the rotary support portion 23, and a contacting surface 23*b* is formed at its tip end to contact a supporting surface 26*b* (indicated by two-dotted chain line) of the support member 26. Also, the connecting portion 25 integrally formed with the main body portion 24 is formed in parallel with the tangential direction to the annular part of the rotary support portion 23, and a contacting surface 25*a* is formed to contact a supporting surface 26*a* (indicated by two-dotted chain line) of the support member 26. In FIG. 29, as the support surfaces 26*a* and 26*b* are orthogonal to each other, the contacting surface 25*a* and contacting surface 23*b* are formed so as to be orthogonal to each other. However, these surfaces may be formed in accordance with the connecting structure of the support member 26 with the connecting portion 25 and rib 23*a*.

The above-described rib 23*a* is provided for relieving stress concentration applied to a bottom portion of the rotary support portion 23 at a boundary with the curved surface portion 20*a*, because it is not possible to thicken the bottom portion more than is necessary, in order to avoid any interference with other devices. For example, when the pipe (P) is bent, a load (L) is supposed to be applied to the rotary support portion 23 as indicated by a blank arrow in FIG. 34. However, its component force (La) is applied to the rib 23*a*, whereas its component force (Lb) is applied to the fitting protrusion 22, so that the stress concentration applied to the bottom portion of the rotary support portion 23 will be cancelled. Furthermore, on the rib 23*a*, as shown in FIGS. 27 and 29, between the bottom portion of the rotary support portion 23 and the contacting surface 25*a*, there is formed a large cross section portion 23*c*, the cross section area of which is formed so as to be decreased gradually up to the contacting surface 25*a*. The large cross section portion 23*c* is formed so as to avoid the interference with other devises, when the bending angle of the pipe (P) is set to be large. Therefore, the rib 23*a* may be formed in such a shape and cross section area that can ensure the necessary component force (Lb).

According to the counter pressure member 20 of the present embodiment, a plan view of which is shown in FIG.

Figure 30:
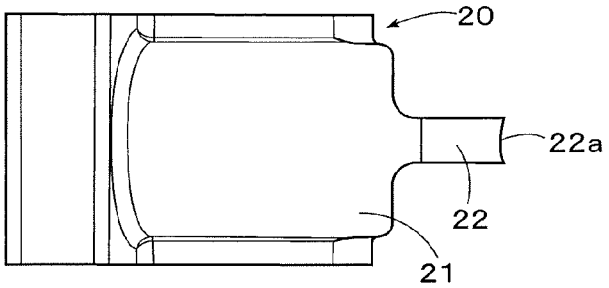
FIG. 30 is a cross sectional view as viewed from "B" in FIG. 29 showing a counter pressure member for use in a further embodiment of the present invention.
Figure 31:
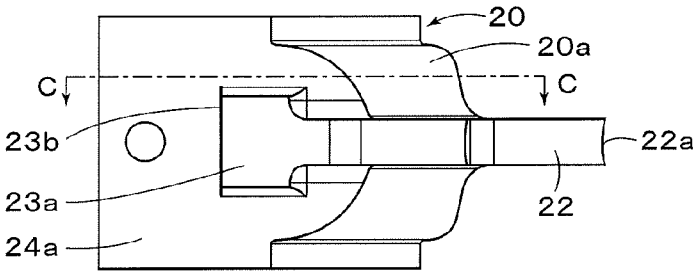
FIG. 31 is a rear view of a counter pressure member for use in a further embodiment of the present invention.

29, a view as viewed from "B" of which is shown in FIG. 30, and a rear view of which is shown in FIG. 31, the outer peripheral surface 22*a* of the fitting protrusion 22, i.e., the outer peripheral surface of the rotary support portion 23 is formed in the curved surface, the end face of the second groove 21 is curved in shape as viewed from the rear (or front) surface, and formed into a straight line as viewed from "B", and the rib 23*a* appears in FIG. 31. In FIG. 29, an inclined angle (θa) of the straight line portion as viewed from "B" against the straight line (V) line as indicated by one-dotted chain line in FIG. 20 is provided according to diameter and wall thickness of the pipe (P) to be bent. In the case where the wall thickness of the pipe (P) is relatively large to its diameter, the inclined angle is set to be large, and in the case where the wall thickness of the pipe (P) is relatively small, the inclined angle is set to be small.

Figure 32:
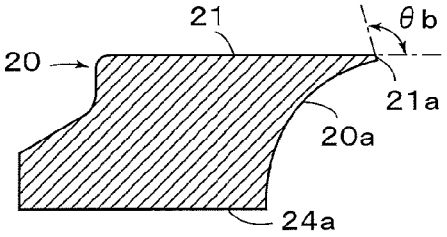
FIG. 32 is a cross sectional view sectioned along C-C line in FIG. 31 showing a counter pressure member for use in a further embodiment of the present invention.

As shown in FIG. 32 sectioned along C-C line of FIG. 31, an obtuse angle is provided for an angle (θb) between the second groove part 21 of half-circular cross section of the main body portion 24 and a side surface 21*a* of an end portion of the second groove part 21 formed next to the curved surface portion 20*a*. Consequently, durability of the end portion of the second groove part 21 according to the counter pressure member 20 is improved, comparing with a usual case where a right or acute angle is provided for the angle (θb). Also, instead of the boundary of the second groove part 21 of the main body portion 24 and the side surface 21*a* of its end portion being set to be straight, a cross section with a smoothly curved line may be employed, so that the durability of the end portion of the second groove part 21 is further improved. In FIGS. 31 and 32, "24*a*" indicates the outer surface of the main body 24. Furthermore, as shown in FIG. 33, a curved surface portion 21*b* is formed on the boundary between the curved surface portion 20*a* and the rotary support portion 23, so that the stress concentration, which is applied to the portion 21*b* when the pipe (P) is bent, is relieved.

Although the counter pressure member 20 has the rotary support portion 23 and the main body portion 24 integrally formed therewith as described above, a large load is applied to the rotary support portion 23 through the pipe (P) to be bent, whereby the wear is unavoidable, so that its replacement will be required after a long term use of it. In view of this, it may be so configured that the counter pressure member 20 to be fixed to the support member 26 is further divided into a first member 20*x*, which includes a main part of the rotary support portion 23 and connecting portion 25, and a second member 20*y*, which includes a part 23*y* of the rotary support portion 23 and the main body portion 24, and that they are connected by bolts for example, thereby to configure the counter pressure member 20. Consequently, in the case where the rotary support portion 23 is worn, only the second member 20*y* including the worn part 23*y* may be replaced, so that the replacement is easily made, and that an inexpensive counter pressure member 20, and therefore an inexpensive bend die unit 100, can be provided in view of a long term use of it, to result in a cost down.

Figure 37:
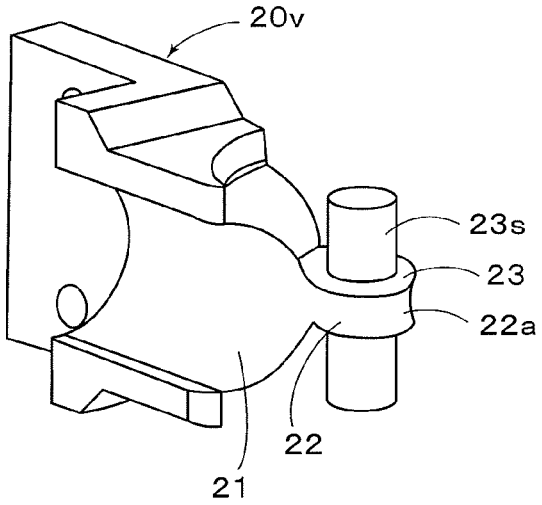
FIG. 37 is a perspective view showing a counter pressure member for use in a pipe bend die unit according to a further embodiment of the present invention.

FIG. 37 illustrates a yet further embodiment of the counter pressure member 20, which is indicated by "20*v*", and an axial portion 23*s* served as the rotary axis (A) is integrally formed with the rotary support member 23 of the counter pressure member 20. The upper part and lower part of the axial portion 23*s* are rotatably supported on the upper section 40 and lower section 50 as shown in FIG. 15 for example, respectively. Consequently, the axial member 60 as shown in FIG. 15 and etc. is not be required, so that the pipe bend die unit can be manufactured easily at low cost.

Figure 38:
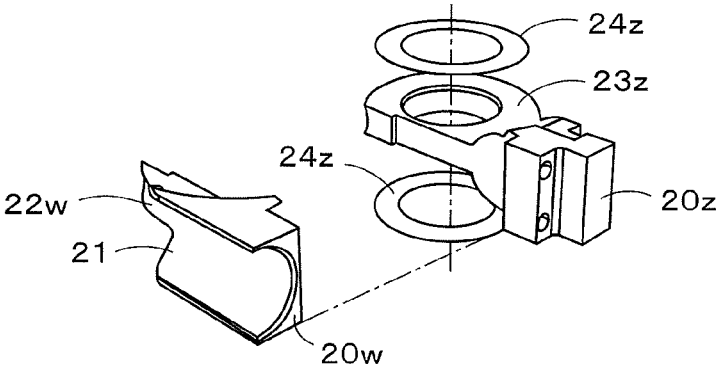
FIG. 38 is a perspective view showing a further embodiment of a counter pressure member for use in a pipe bend die unit according to an embodiment of the present invention.

As shown in FIG. 38, the counter pressure member 20 may be divided into two members of a mating member 20*w* including the fitting protrusion portion 22*w* and a rotary support member 20*z* supported to be rotatable about the rotary axis (A), in such a manner that the mating member 20*w* is detachably connected to the rotary support member 20*z*. Consequently, in the case where the counter pressure member 20 is required to be replaced, only the mating member 20*w* may be used for a repair part to be replaced as described above, so that an inexpensive unit as a whole can be configured. As for the rotary support member 20*z*, it may be configured by a rotary support portion 23*z* and a pair of bearing members 24*z*, 24*z* fixed thereto.

Figure 39:
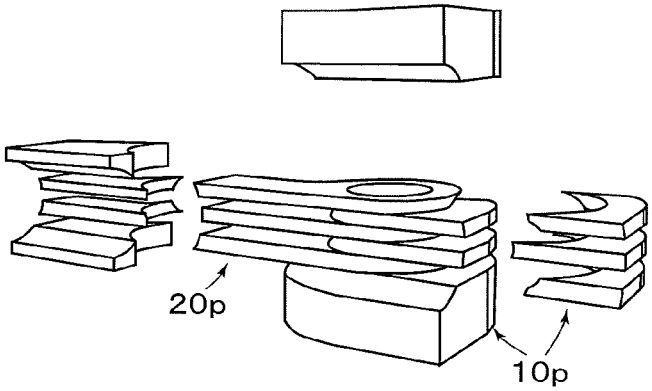
FIG. 39 is a perspective view showing a clamp member and counter pressure member for use in a pipe bend die unit according to an embodiment of the present invention.

Or, as shown in FIG. 39, the clamp member 10 and the counter pressure member 20 may be configured by a plurality of parts divided by planes perpendicular to the rotary axis (A), respectively, and stacked one over another to produce a clamp member 10*p* and a counter pressure member 20*p*. That is, by stacking the plurality of parts, the clamp member 10*p* and counter pressure member 20*p* can be configured, and a hinged connection between them can be configured at the same time.

Figure 40:
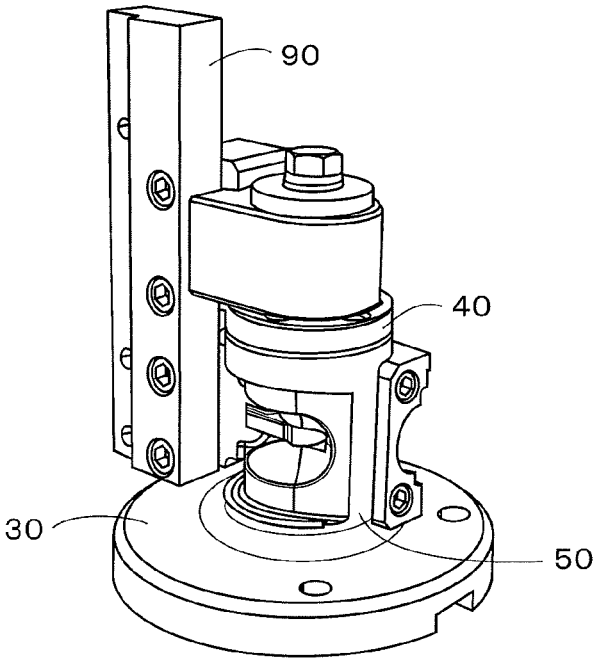
FIG. 40 is a perspective view showing a pipe bend die unit according to a further embodiment of the present invention.

Or, as shown in FIG. 40, the upper section 40 and the lower section 50 may be supported by a common support member 90. Consequently, supporting strength required for the axial member 60 can be provided within the pipe bend die unit. Therefore, a head portion of the axial member 60 is not required to be fixed separately, a die change can be made easily, and any concern about interference with other devices is not needed, so that the die change can be made more easily.

Figure 41:
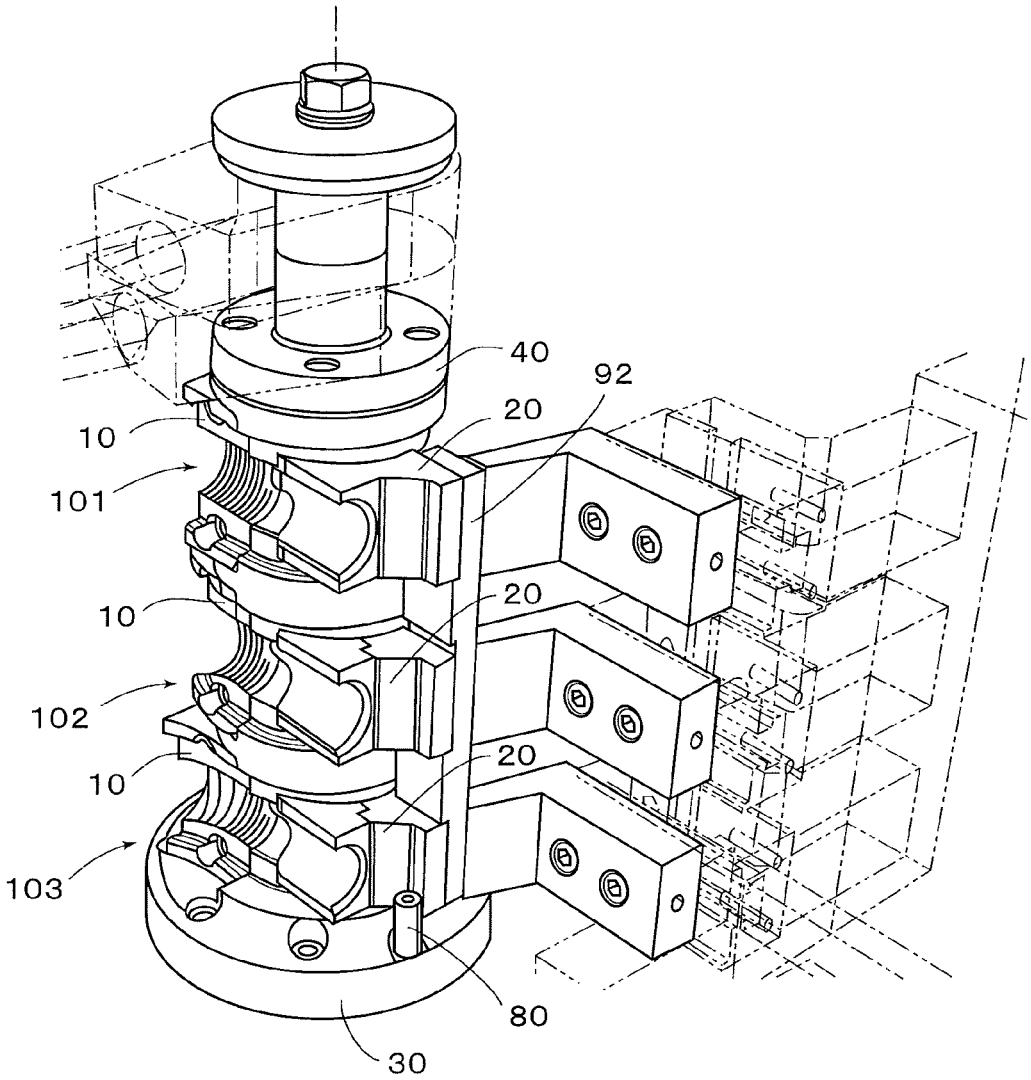
FIG. 41 is a perspective view showing a pipe bending apparatus according to a further embodiment of the present invention.

Furthermore, as shown in FIG. 41, a plurality of bend dies 101, 102 and 103 each having the clamp member 10 and the counter pressure member 20 may be stacked and supported about the rotary axis (A). In each clamp member 10 and counter pressure member 20, they are configured to be hingedly connected about the rotary axis (A), respectively. According to each die, compressive stress is appropriately applied to the inner side of bent portion of the pipe (P), as described before, so that bending of each pipe (P) can be achieved simultaneously and appropriately, without causing the crinkling. According to the present embodiment, each clamp member 10 is supported by a common base 30, and each counter pressure member 20 is supported by a common support member 92. Therefore, by means of a single knock pin 80, the initial relative position between each clamp member 10 and each counter pressure member 20 can be easily set, and no adjustment after the die change is required. It may be so configured that each clamp member 10 is fixed, and that each counter pressure member 20 is movable thereto.

Figure 42:
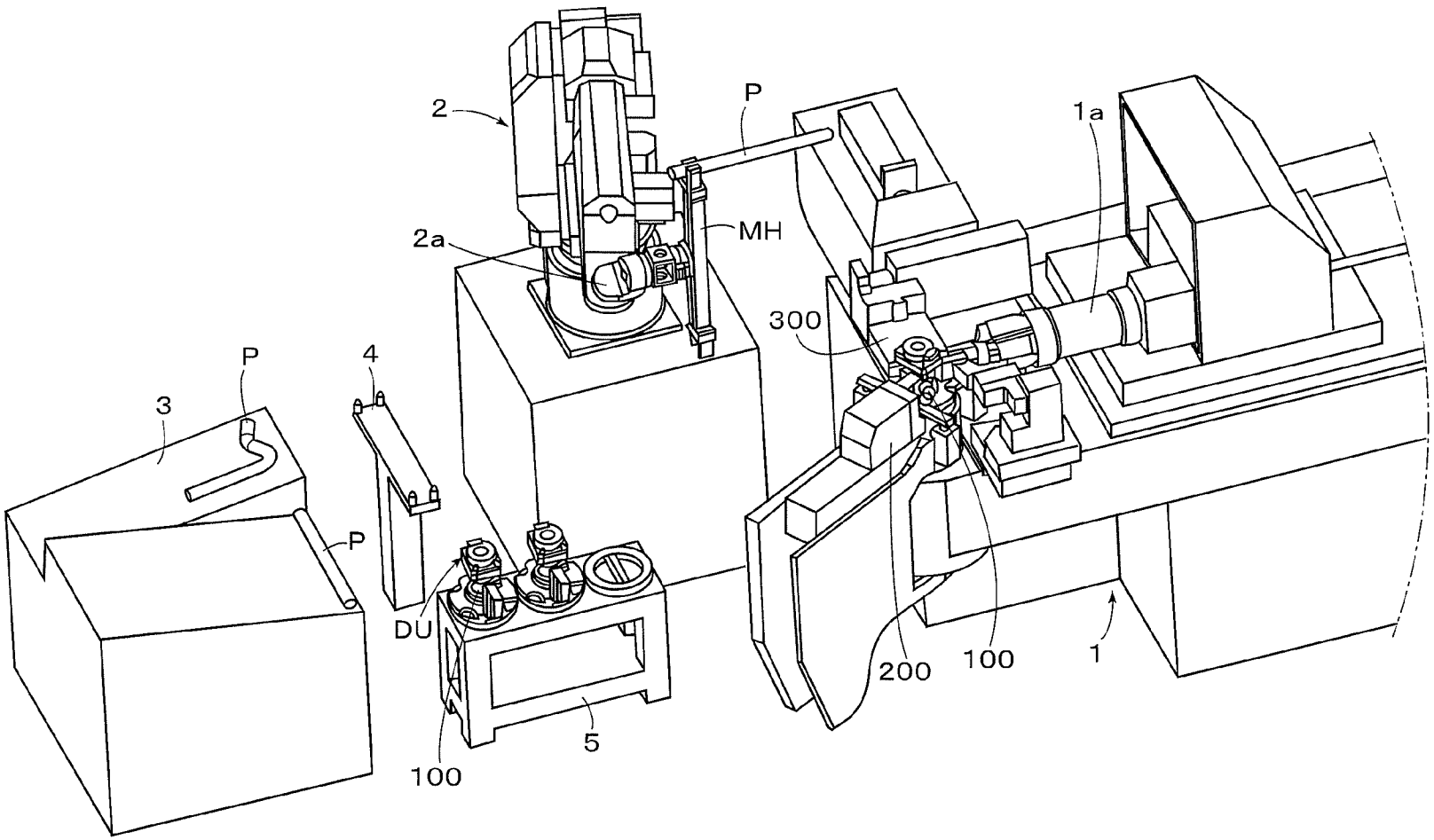
FIG. 42 is a perspective view showing a working state of an automatic pipe bending apparatus using a pipe bend die unit according to an embodiment of the present invention.
Figure 43:
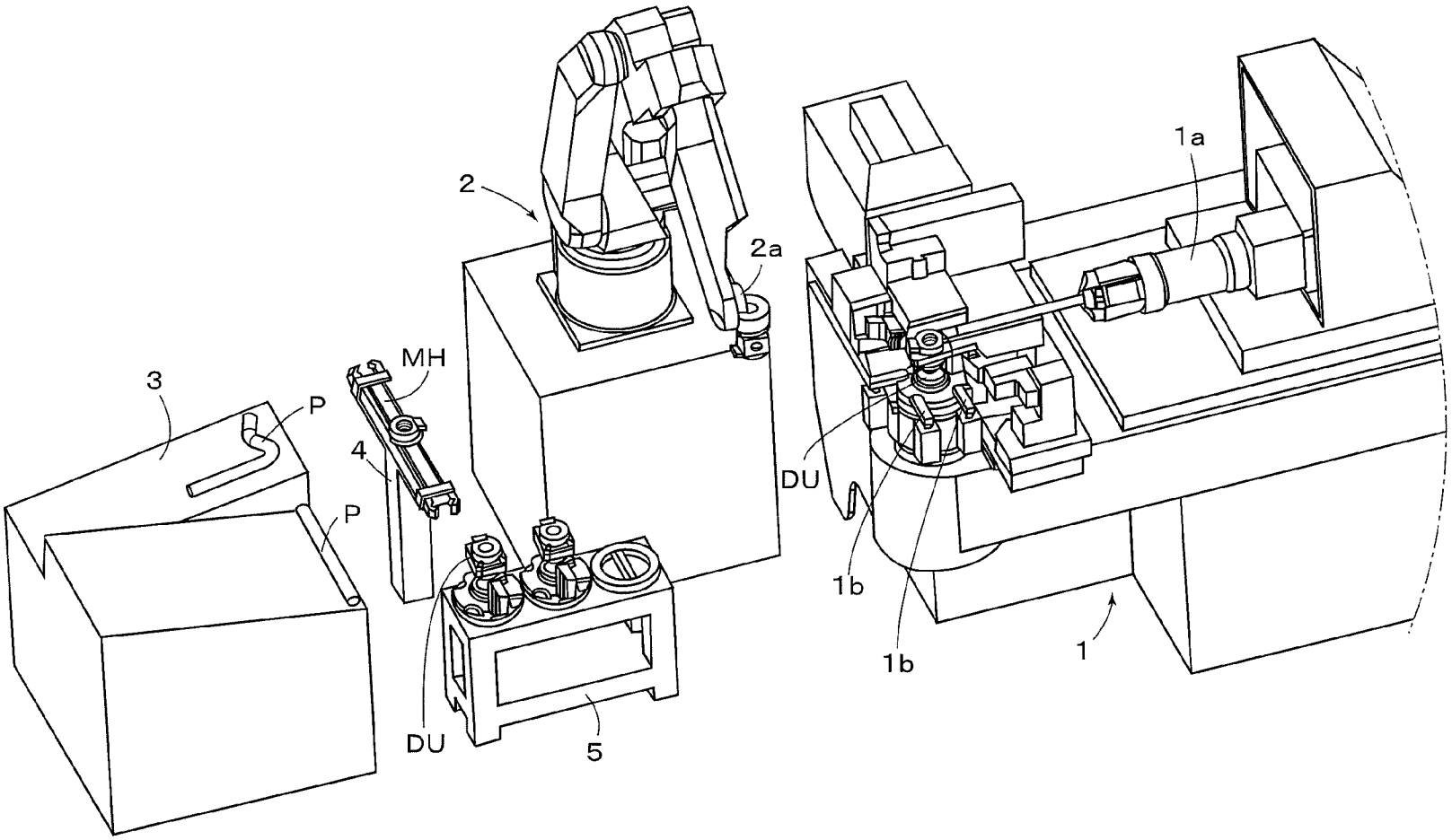
FIG. 43 is a perspective view showing a die change preparation state of an automatic pipe bending apparatus using a pipe bend die unit according to an embodiment of the present invention.
Figure 44:
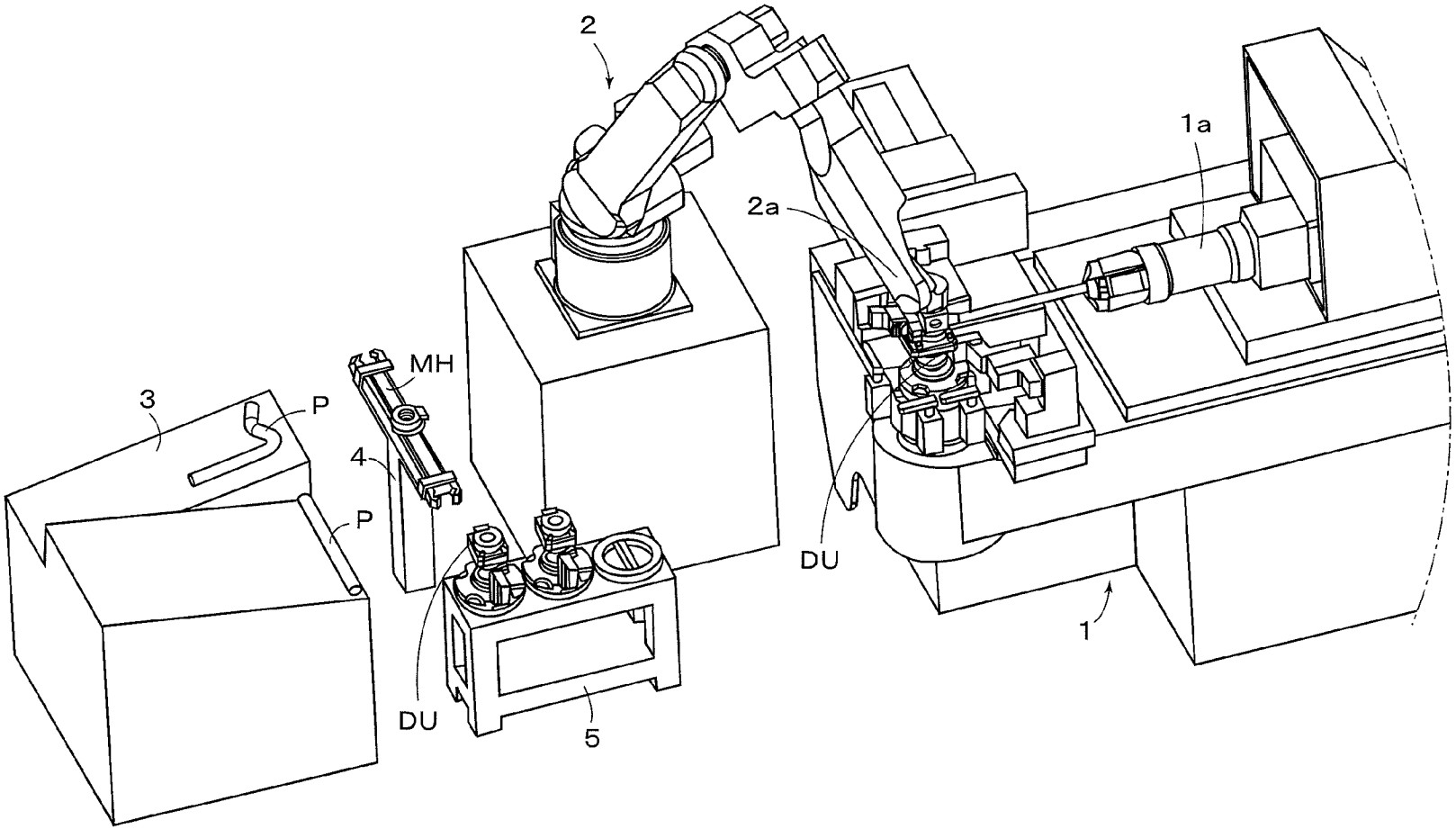
FIG. 44 is a perspective view showing a die change starting state of an automatic pipe bending apparatus using a pipe bend die unit according to an embodiment of the present invention.
Figure 45:
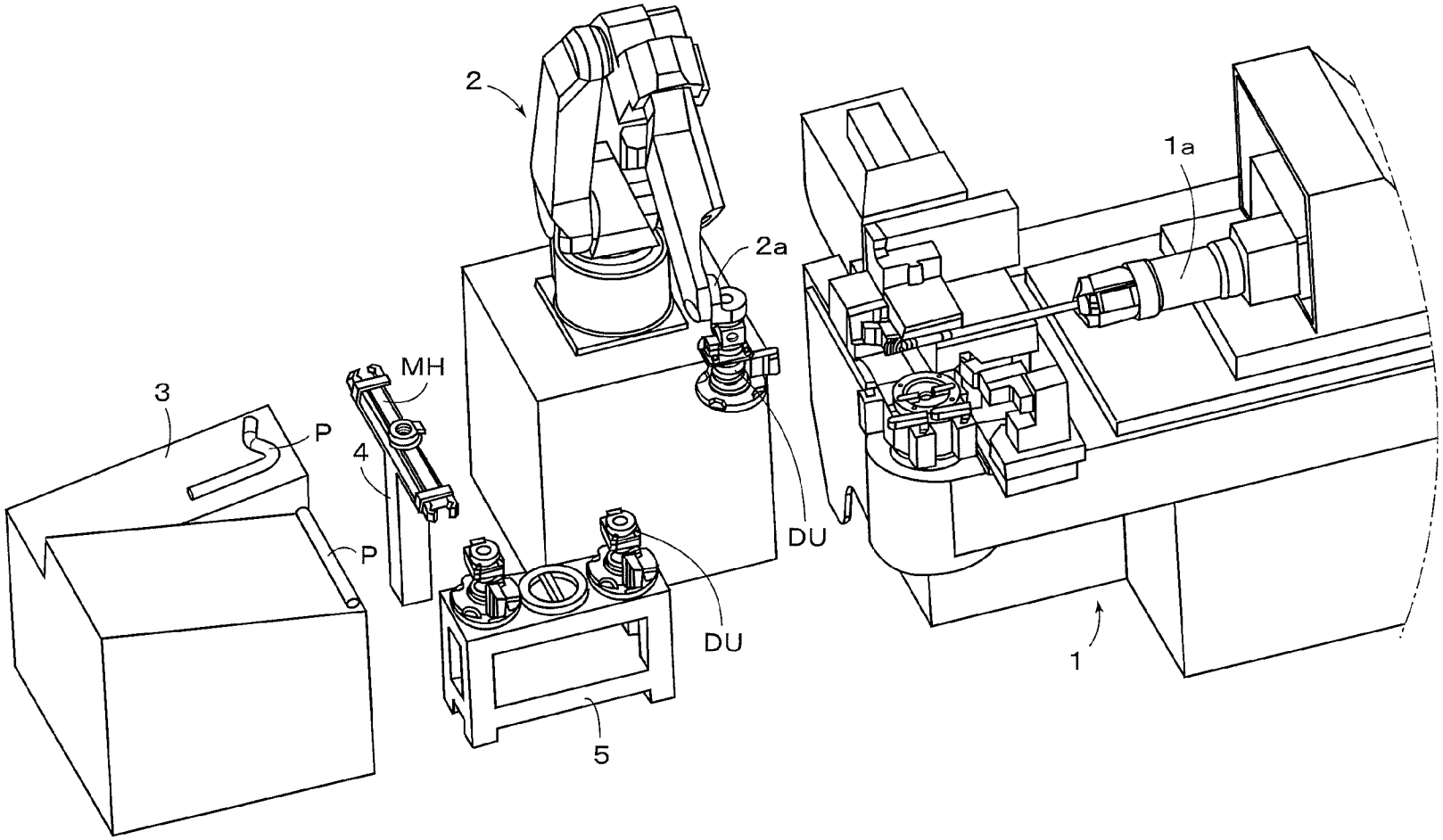
FIG. 45 is a perspective view showing a die changing state of an automatic pipe bending apparatus using a pipe bend die unit according to an embodiment of the present invention.

Next will be explained about an example of a production line for an automotive pipe bending apparatus using the pipe bend unit as disclosed in FIG. 1 and so on, with reference to FIGS. 42-45. FIG. 42 shows a bend working state of the pipe (P), FIG. 43 shows the die change preparing state of the pipe bend unit that is formed in the same configuration as that shown in FIG. 16, and that is indicated by "DU" to show an automatic working unit, FIG. 44 shows the die change starting state, and FIG. 45 shows the die changing state. At the outset, the automatic pipe bending apparatus will be roughly explained with reference to FIG. 42. The automatic pipe bending apparatus 1 of the present embodiment is equipped with a mechanism 1*a* for applying the axial pressure load, in addition to the bend die 100, clamp die 200, pressure die 300 and etc. as shown in FIG. 1. Next to the pipe bending apparatus 1, there is placed a robot device 2 for supplying the pipe (P) to be formed, and placing it at a predetermined initial position. Furthermore, next to the robot device 2, there is placed a pipe placing table 3 for placing thereon the material to be formed, and the formed pipe (P). Between the pipe placing table 3 and the robot device 2, there is placed a clamping jig placing table 4 for placing thereon a clamping jig (MH), temporarily. And, next to the pipe bending apparatus 1 and robot device 2, there is placed a pipe bend die unit placing table 5 (hereinafter simply referred to as a unit table 5) for placing thereon the pipe bend unit (DU), hereinafter simply referred to as a unit (DU).

According to the robot device 2, the clamping jig (MH) is mounted on a tip end of a robot arm 2*a* through an auto tool changer (ATC). On the opposite ends of the clamping jig (MH), mounted are clamp mechanisms for clamping the pipe (P) to be detachable, one of which is capable of clamping the pipe (P) to be formed, and the other one of which is capable of clamping the formed pipe (P). FIG. 42 shows such a state that the pipe (P) is being formed by the pipe bending apparatus 1, and that the robot device 2, with the clamping jig (MH) clamping the pipe (P) to be formed, is supplying the pipe (P) to the pipe bending apparatus 1, and also waiting for receiving the formed pipe (P) therefrom.

Next, FIG. 43 shows such a state that the robot device 2 is removing the clamping jig (MH) from the tip end of the robot arm 2*a*, and placing it on the clamping jig placing table 4 temporarily, and waiting for changing the unit (DU). According to the pipe bending apparatus 1, the unit (DU) is clamped by a pair of unit holders 1*b*, 1*b*, which will be rotated and retracted to unclamp the unit (DU). And, FIG. 44 shows such a state that the unit (DU) to be changed is being removed from the pipe bending apparatus 1. In this respect, another auto tool changer (ATC) is mounted on the tip end of the unit (DU), and fitted with the auto tool changer (ATC) mounted on the tip end of the robot arm 2*a*, so that the unit (DU) is hanged at the tip end of the robot arm 2*a*, as shown in FIG. 45.

Consequently, a new unit (DU) is removed from the unit table 5 by means of the robot arm 2*a*, and transferred to the pipe bending apparatus 1 as shown in FIG. 45. On the unit table 5, various kinds of the unit (DU) are placed at designated positions according to a program for a moving locus of the robot arm 2*a*, so that the unit (DU) is selected from the units on the unit table 5 by the robot arm 2*a* according to a die change order, and installed on the pipe bending apparatus 1.

The die change of the unit (DU) for the pipe bending apparatus 1, i.e., changing and installing the unit (DU), and operation of the pipe bending apparatus 1, i.e., bending the pipe (P) can be automated, and the unit (DU) can be provided with intelligence to expect a more advanced automation. For example, it may be so configured that various kinds of sensors or cameras are installed on the unit (DU), or a laser beam is applied, and that working data are measured at real time to be stored in a memory tip or the like embedded in the unit (DU). Or, it may be so configured that a communication means embedded in the unit (DU) is transmitting serial working data to a line-controller or the like, to store the data therein. In the case where it is so configured that the working data are stored in the memory tip or the like embedded in the unit (DU), the working data may be transmitted by wire to the line-controller or the like through the robot device 2, or may be stored in the pipe bending apparatus 1. Furthermore, it may be so configured that a remote counting of the formed products under a license for bending the pipe by means of the unit (UD) may be performed by transmitting the working data through the aforementioned communication means. According to the automatic operation and/or automatic die change, therefore, the positions or states of the unit (DU) can be traced sequentially, and also more effective working conditions, automatic operation and/or automatic die change can be provided by analyzing the stored data, thereby to contribute an automatic factory system. According to the automatic die change line as described above, only the unit (DU) was selected as a target for the die change, while it may be so configured that the automatic change of the pressure die, clamp die, and mandrel as well can be made adequately by robot means depending on difference of diameters of the pipes to be formed according to the die change, or difference in thickness of the pipes (with the same diameter).

Figure 46:
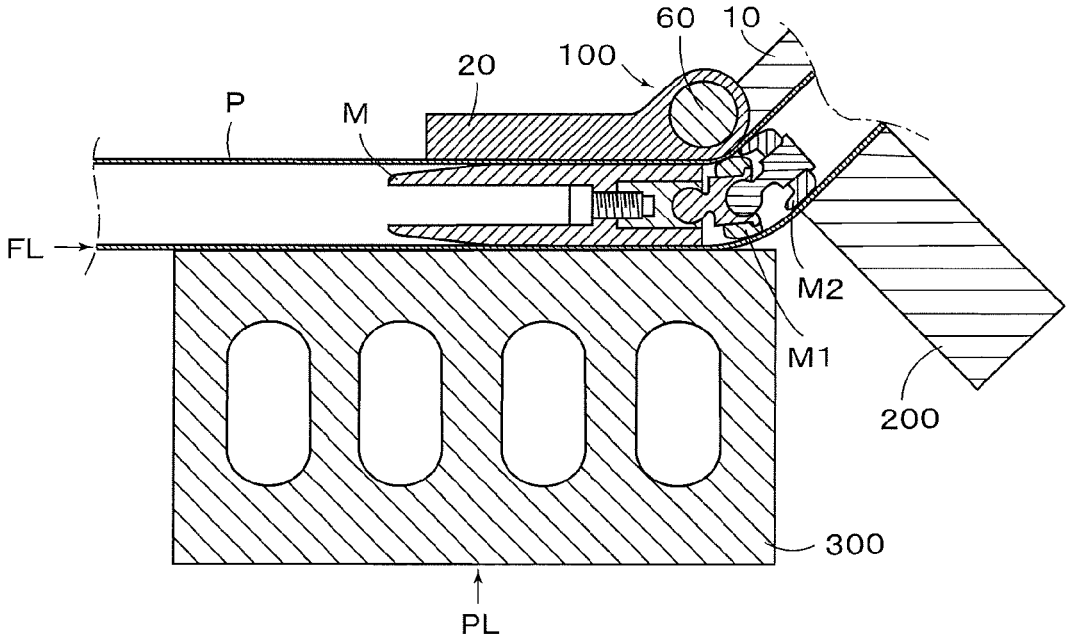
FIG. 46 is a sectional view showing a pipe bending state of a pipe bending apparatus using a pipe bend die unit according to an embodiment of the present invention.
Figure 47:
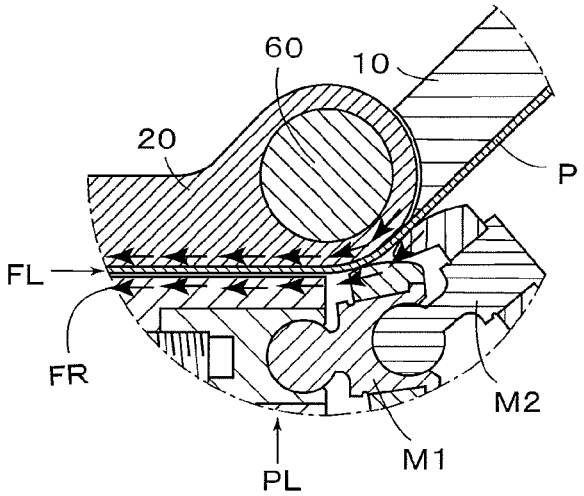
FIG. 47 is a sectional view enlarging a part of FIG. 46.
Figure 48:
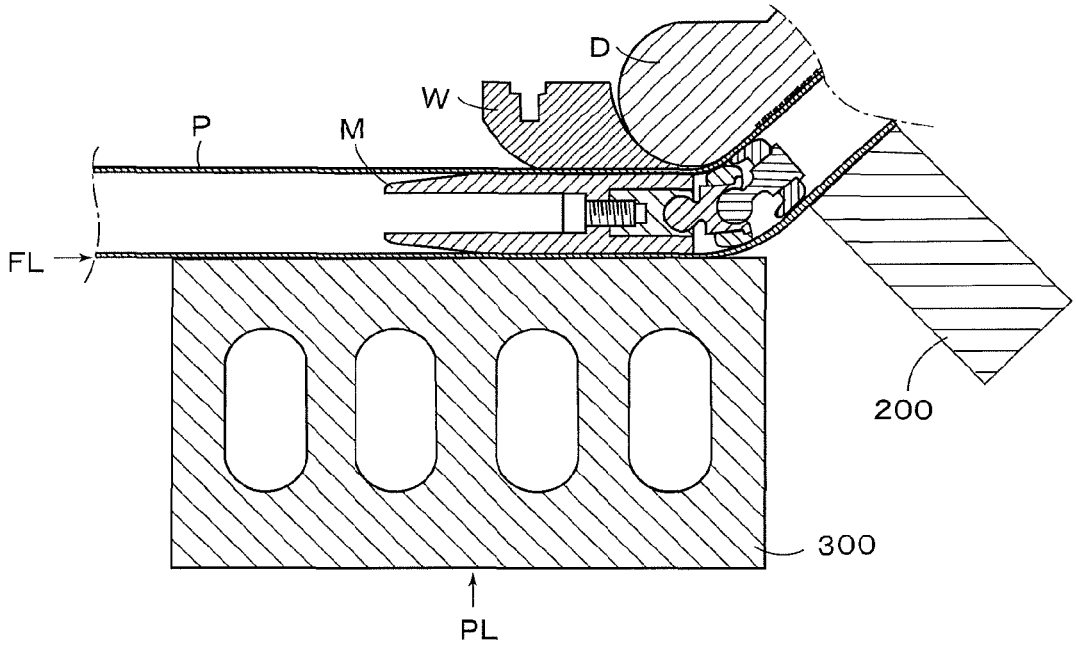
FIG. 48 PRIOR ART
FIG. 48 is a sectional view showing a pipe bending state of a rotary drawing bend apparatus having a prior bend die and a wiper.
Figure 49:
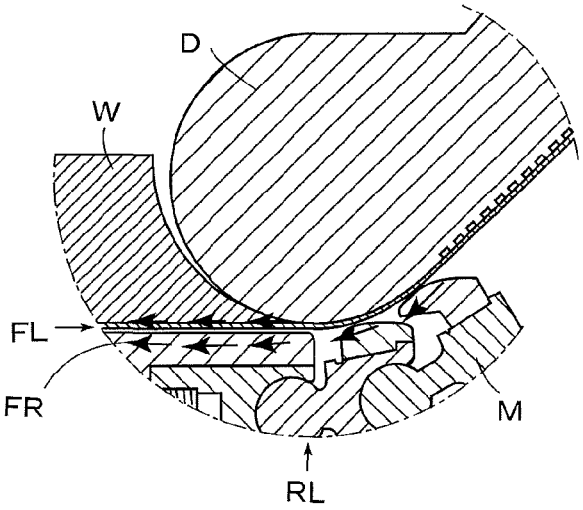
FIG. 49 PRIOR ART
FIG. 49 is a sectional view enlarging a part of FIG. 48.

Next, FIGS. 46 and 47 show a state of the pipe being bent according to the pipe bending apparatus using the pipe bend die unit as shown in FIG. 1 and so on, whereas FIGS. 48 and 49 show a state of the pipe being bent according to the rotary draw bending apparatus using the prior bend die and wiper, to be compared with the present embodiment. At the outset, in order to form a pipe with a small bending radius, it is required to apply a large pressure in the axial direction and radial direction of the pipe. Particularly, in order to apply the large pressure in the radial direction, the configuration as shown in FIG. 46 requires such a mechanism as to be capable of opposing against a large load applied to the pipe (P) by the pressure die 300.

According to the present invention, it is so configured that the bend die 100 of the aforementioned embodiment, especially the counter pressure member 20 hingedly connected to the clamp member 10 functions as that mechanism, so as to be capable of opposing the large load by the pressure die 300 sufficiently. As shown in FIG. 46, axially pressing load (indicated by "FL") and compressing load (indicated by "PL") are applied to the pipe (P). According to the present embodiment, sufficient pressure proof strength against the large load by the pressure die 300 can be ensured, because the clamp member 10 and the counter pressure member 20 are hingedly connected as shown in FIG. 2, such that the fitting portion (F) of the fitting protrusion 22 that is fitted in the fitting recess 12, which portion (F) is not included in the planar surfaces perpendicular to the rotary axis (A), is located at the foreside in an advancing direction of the pipe (P) relative to the initial position of bending operation (S), as shown in FIG. 2, and the mating portion (R) of the first groove part 11 of the clamp member 10 and the second groove part 21 of the counter pressure member 20 is located at the backside of the advancing direction of the pipe (P). Furthermore, in such a state that the mandrel (M) (ball mandrels M1 and M2) is inserted into the pipe (P), the compressing load (PL) applied to the pipe (P) can be made larger, so that the bending radius of the pipe (P) can be made minimum.

Also, as enlarged in FIG. 47, in order to avoid reduction of thickness at the outer side of the pipe (P) caused by bending the pipe (P), it is so configured that the axially pressing load (FL) is applied to the pipe (P), so that the pipe (P) is fed with material, thereby to enlarge its thickness. At the inner side of the pipe (P) to be bent, however, a friction force (indicated by a leftward arrow "FR" in FIG. 47) is caused by the compressing load (PL) against the axially pressing load (FL), so that the thickness will be increased by that friction force (FR). Furthermore, if the axially pressing load (FL) is applied in the state that the mandrel (M) has been inserted into the pipe (P), the pipe (P) is advanced (moved to the rightward in FIG. 47) in such a state as being compressed between the mandrel (M) and the counter pressure member 20, so that the thickness will be more largely increased, with squeezing operation being added by both of the members.

In contrast, according to the rotary bending apparatus using the prior bend die and wiper for preventing the crinkling, it is arranged in such a manner that the wedge shaped wiper (W) will squeeze into a clearance between the pipe (P) and bend die (D) as shown in FIG. 48, the tip end of the wiper (W) is made extremely thin, so as to reduce the clearance between the pipe (P) and wiper (W) as small as possible, so that the wiper (W) is likely to be fragile. Therefore, if the large load by the pressure die 300 is continuously applied to the wiper (W), its tip end will be deformed or destroyed, to enlarge the clearance between the same and the pipe (P), thereby to cause the crinkling. In order to avoid the crinkling, it is required to maintain the extremely thin tip end of the wiper (W), so that a periodical change of the wiper (W) and a change for a destroyed one have been necessarily required. Also, as the pipe is bent to avoid the crinkling from being caused, the radius of the pipe (P) to be bent is limited, so that the maximum radius of the pipe (P) to be made will be approximately 2 of the aforementioned r/d ratio, at most.

According to the prior rotary bending apparatus, although the bending of the pipe (P) is performed in the state that the mandrel (M) has been inserted into the pipe (P), and the friction force (FR) is caused as shown in FIG. 49, no sliding motion is made between the pipe (P) and bend die (D) basically, but a following motion of the pipe (P) is made in response to rotating motion of the bend die (D), so that increase of the thickness cannot be expected by the friction force (FR). FIGS. 48 and 49 are prepared to simply show operation and effect according to the prior art, to be compared with the operation and effect according to the present invention using the pipe bend die unit. FIGS. 48 and 49 are not intended to imply that such known apparatuses are comparable to the pipe bend die unit of the present invention.

DESCRIPTION OF CHARACTERS

1 pipe bending apparatus
2 robot device
3 pipe placing table
4 clamping jig placing table
5 pipe bend die unit placing table
10 clamp member
10*a* clamp portion
10*b* circularly recessed portion
11 first groove part
12 fitting recess
13 base portion
20 counter pressure member
20*a* curved surface portion
21 second groove part
22 fitting protrusion
23 rotary support portion
40 upper section
50 lower section
60 axial member
70 holding member
80 knock pin
100 bend die
200 clamp die
300 pressure die
A rotary axis
P pipe
M mandrel

The invention claimed is:

1. A pipe bend die unit comprising a bend die with a pipe-receiving groove of half-circular cross section formed on an outer peripheral surface of the bend die to receive a pipe to be bent about a bending center, the bend die comprising:

a clamp member rotatable about a rotary axis and having a first groove part of half-circular cross section on an outer peripheral surface of the clamp member with a fitting recess formed on the first groove part and extending in a peripheral direction by a first predetermined length on a planar surface perpendicular to the rotary axis, the rotary axis passing through the bending center of the pipe, the rotary axis passing through the fitting recess;

a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another so as to be rotatable relative to each other about the rotary axis;

the fitting protrusion of the counter pressure member including a fitting portion positioned in the fitting recess, the fitting portion that is fitted in the fitting recess being located at a foreside in an advancing direction of the pipe relative to a position where a bending operation of the pipe is initiated;

a mating portion at which the first groove part of the clamp member and the second groove part of the counter pressure member mate with each other being located at a backside in the advancing direction of the pipe relative to the position where the bending operation of the pipe is initiated;

the clamp member including a circularly recessed portion forming the first groove part of half-circular cross section, the fitting recess extending in a peripheral direction on a planar surface perpendicular to the rotary axis, the fitting recess being located at a bottom center of the circularly recessed portion, the first groove part of half-circular cross section being continuous with the circularly recessed portion including a part of the fitting recess; and the counter pressure member including a curved surface portion formed on opposite sides of the planar surface, the curved surface portion being configured to contact the circularly recessed portion, the curved surface portion possessing an arch center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis, next to the curved surface portion.

2. The pipe bend die unit of claim 1, wherein the counter pressure member has an annular rotary support portion mounted to be rotatable about the rotary axis, and wherein a part of the rotary support portion forms the fitting protrusion, and the rotary support portion possesses an outer peripheral surface, the outer peripheral surface of the rotary support portion being a curved surface forming a part of the pipe-receiving groove of half-circular cross section.

3. The pipe bend die unit of claim 1, wherein the counter pressure member and the clamp member are hingedly connected by an axial member having a central axis passing through the fitting recess.

4. The pipe bend die unit of claim 1, wherein the counter pressure member has an annular rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, and wherein the rotary support portion forms the fitting protrusion, and the rotary support portion possesses an outer peripheral surface, the outer peripheral surface of the rotary support portion being a curved surface forming a part of the pipe-receiving groove of half-circular cross section.

5. The pipe bend die unit of claim 4, wherein the second groove part of half-circular cross section of the body portion of the counter pressure member forms an obtuse angle with a side surface of an end portion of the second groove part formed next to the curved surface portion.

6. The pipe bend die unit of claim 4, wherein the counter pressure member comprises at least a first member and a second member, the rotary support portion constituting a main part of the first member, and the body portion constituting a main part of the second member, the counter pressure member being formed by combining the first member and the second member.

7. The pipe bend die unit of claim 1, wherein the bend die is configured by an upper section and a lower section divided by a surface perpendicular to the rotary axis, the fitting protrusion of the counter pressure member being disposed between the upper section and the lower section.

8. The pipe bend die unit of claim 1, wherein the counter pressure member is divided into at least two members, the at least two members being a mating member including the fitting protrusion and a rotary support member supported to be rotatable about the rotary axis, the mating member being detachably connected to the rotary support member.

9. The pipe bend die unit of claim 1, wherein the clamp member and the counter pressure member comprise a plurality of members divided by a plurality planes perpendicular to the rotary axis, and wherein the plurality of members are stacked to form the clamp member and the counter pressure member.

10. The pipe bend die unit of claim 1, further comprising a knock pin fixed to a predetermined position of the clamp member, to provide an initial relative position between the clamp member and the counter pressure member by a position where the counter pressure member abuts on the knock pin.

11. A pipe bending apparatus comprising:

a bend die having a pipe-receiving groove of half-circular cross section on an outer peripheral surface of the bend die to receive a pipe to be bent about a bending center, the bend die being rotatable about a rotary axis;

a clamp die for clamping a pipe to be bent that is positioned in the pipe-receiving groove of the bend die; and a pressure die for pressing the pipe toward the bend die, wherein the bend die comprises:

a clamp member rotatable about a rotary axis and having a circularly recessed portion forming a first groove part of half-circular cross section on an outer peripheral surface of the clamp member with a fitting recess formed on the first groove part and extending in a peripheral direction by a first predetermined length on a planar surface perpendicular to the rotary axis, the rotary axis passing through the bending center of the pipe, the rotary axis passing through the fitting recess;

a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another so as to be rotatable relative to each other about the rotary axis, to configure a pipe bend die unit;

the fitting recess extending in a peripheral direction on a planar surface perpendicular to the rotary axis, the fitting recess being located at a bottom center of the circularly recessed portion of the clamp member, the first groove part of half-circular cross section being continuous with the circularly recessed portion including a part of the fitting recess; and the counter pressure member including a curved surface portion formed on opposite sides of the planar surface, the curved surface portion being configured to contact the circularly recessed portion, the curved surface portion possessing an arc center on an axis offset from the rotary axis and perpendicular to the planar surface in a direction spaced from the rotary axis, the second groove part on the outer peripheral surface of the fitting protrusion possessing the half-circular cross section, with a bottom center of the second groove part being provided on the planar surface perpendicular to the rotary axis adjacent the curved surface portion.

12. The pipe bending apparatus of claim 11, wherein one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated.

13. The pipe bending apparatus of claim 11, wherein the counter pressure member has an annular rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, and wherein the rotary support portion forms the fitting protrusion, and the rotary support portion possesses an outer peripheral surface, the outer peripheral surface of the rotary support portion being a curved surface forming a part of the pipe-receiving groove of half-circular cross section.

14. The pipe bending apparatus of claim 13, wherein the counter pressure member comprises at least a first member and a second member, the rotary support portion constituting a main part of the first member, and the body portion constituting a main part of the second member, the counter pressure member being formed by combining the first member and the second member.

15. The pipe bending apparatus of claim 11, wherein the counter pressure member and the clamp member are hingedly connected by an axial member having a central axis passing through the fitting recess.

16. The pipe bending apparatus of claim 11, wherein the bend die is configured by an upper section and a lower section divided by a surface perpendicular to the rotary axis, the fitting protrusion of the counter pressure member being disposed between the upper section and the lower section.

17. The pipe bending apparatus of claim 11, further comprising a knock pin fixed to a predetermined position of the clamp member, to provide an initial relative position between the clamp member and the counter pressure member by a position where the counter pressure member abuts on the knock pin.

18. The pipe bending apparatus of claim 11, further comprising a mandrel with a tip end portion thereof being inserted into the pipe, the mandrel being driven such that the tip end portion opposes the pressure die within a predetermined rotating region of the bend die.

19. A pipe bend die unit comprising a bend die with a pipe-receiving groove of half-circular cross section formed on an outer peripheral surface of the bend die to receive a pipe to be bent during a bending operation that produces a bent portion in the pipe, the bend die being rotatable about a rotary axis, and the bend die comprising:

a clamp member that includes a first groove part of half-circular cross section on an outer peripheral surface of the clamp member with a fitting recess formed on the first groove part and extending in a peripheral direction by a first predetermined length on a planar surface perpendicular to the rotary axis;

the clamp member also possessing a circularly recessed portion that is continuous with the first groove part that faces the bent portion of the pipe during the bending operation and around which the pipe is bent during the bending operation, the circularly recessed portion being integral with the clamp member to rotate together with the clamp member about the rotary axis, the rotary axis passing through the fitting recess;

a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the counter pressure member and the clamp member being hingedly connected to one another so as to be rotatable relative to each other about the rotary axis;

the fitting protrusion possessing an outer circumferential surface that is a concave curved surface, the concave curved outer circumferential surface of the fitting protrusion being a part of the pipe-receiving groove of half-circular cross section; and the counter pressure member including a first convex curved surface portion that is convexly curved in a direction upwardly away from the fitting protrusion when the fitting protrusion is positioned horizontally, the counter pressure member also including a second convex curved surface portion that is convexly curved in a direction downwardly away from the fitting protrusion when the fitting protrusion is positioned horizontally, the first and second convex curved surface portions each being of limited circumferential extent so that each of the first and second convex curved surface portions extends around only a portion of a circumference of the fitting protrusion, each of the first and second convex curved surface portions engaging respective concave surface portions of the circularly recessed portion of the clamp member and sliding along the circularly recessed portion of the clamp member during relative rotation of the clamp member and the counter pressure member.

* * * * *